US007481884B2

(12) United States Patent
Stelter et al.

(10) Patent No.: US 7,481,884 B2
(45) **Date of Patent: *Jan. 27, 2009**

(54) POWDER COATING APPARATUS AND METHOD OF POWDER COATING USING AN ELECTROMAGNETIC BRUSH

(75) Inventors: Eric C. Stelter, Pittsford, NY (US); Patrick M. Lambert, Rochester, NY (US); Joseph E. Guth, Holley, NY (US); Laverne N. Lincoln, Jr., Macedon, NY (US); Michael W. Frauens, Webster, NY (US); Kenneth P. Friedrich, Honeoye, NJ (US)

(73) Assignee: Eastman Kodak Company, Rochester, NY (US)

( * ) Notice: Subject to any disclaimer, the term of this patent is extended or adjusted under 35 U.S.C. 154(b) by 25 days.

This patent is subject to a terminal disclaimer.

(21) Appl. No.: 11/075,784

(22) Filed: Mar. 9, 2005

(65) Prior Publication Data

US 2005/0202164 A1 Sep. 15, 2005

Related U.S. Application Data

(60) Provisional application No. 60/551,464, filed on Mar. 9, 2004.

(51) Int. Cl.
*B05C 1/08* (2006.01)

(52) U.S. Cl. ..... 118/247; 118/248; 118/249

(58) Field of Classification Search ..... 118/247, 118/248, 249

See application file for complete search history.

(56) References Cited

U.S. PATENT DOCUMENTS 2,919,179 A 12/1959 Van Wagner
3,202,092 A 8/1965 Childress
3,306,193 A 2/1967 Rarey et al.
3,413,716 A 12/1968 Schwertz et al.
3,504,624 A 4/1970 Kennedy, Jr.
3,795,617 A 3/1974 McCabe
3,795,618 A 3/1974 Kasper
4,041,901 A 8/1977 Rarey et al.
4,076,857 A 2/1978 Kasper et al.
4,460,266 A 7/1984 Kopp et al.
4,473,029 A 9/1984 Fritz et al.
4,546,060 A 10/1985 Miskinis et al.
4,602,863 A 7/1986 Fritz et al.
4,764,445 A 8/1988 Miskinis et al.
4,855,206 A 8/1989 Saha
5,001,028 A 3/1991 Mosehauer et al.
5,065,183 A 11/1991 Morofuji et al.
5,084,735 A 1/1992 Ramai et al.

(Continued)

FOREIGN PATENT DOCUMENTS

WO WO 2005/088406 9/2005

OTHER PUBLICATIONS

Sinclair, M., Printing Equip. Engr., Nov. 1948, pp. 21-25.

(Continued)

*Primary Examiner*—George R Koch, III
(74) *Attorney, Agent, or Firm*—Donna P. Suchy

(57) ABSTRACT

Apparatus and methods for applying powder coatings to a substrate either directly or by intermediate transfer using a magnetic brush developer.

18 Claims, 13 Drawing Sheets

U.S. PATENT DOCUMENTS 5,115,276 A 5/1992 Miskinis et al.
5,307,124 A 4/1994 Stelter
5,339,146 A 8/1994 Aslam
5,370,961 A 12/1994 Zaretsky et al.
5,376,492 A 12/1994 Stelter et al.
5,394,230 A 2/1995 Kaukeinen et al.
5,400,124 A 3/1995 Kass et al.
5,409,791 A 4/1995 Kaukeinen et al.
5,464,698 A 11/1995 Chen et al.
5,489,975 A 2/1996 Kaukeinen et al.
5,506,372 A 4/1996 Guth et al.
5,506,671 A 4/1996 Buts et al.
5,512,403 A 4/1996 Tyagi et al.
5,728,496 A 3/1998 Ramai et al.
5,751,432 A 5/1998 Gwaltney
5,804,341 A 9/1998 Bohan et al.
5,807,651 A 9/1998 Rimai et al.
5,821,972 A 10/1998 Mey et al.
5,847,738 A 12/1998 Tutt et al.
5,948,585 A 9/1999 Gady et al.
5,966,576 A 10/1999 Tyagi et al.
5,968,656 A 10/1999 Ezenyilimba et al.
5,968,658 A 10/1999 Kress et al.
5,985,499 A 11/1999 Guth et al.
5,998,080 A * 12/1999 Ohno et al. ..... 430/45.54
6,019,845 A 2/2000 Nakakoshi
6,031,556 A 2/2000 Tutt et al.
6,074,756 A 6/2000 Vreeland et al.
6,162,861 A 12/2000 Kawamoto et al.
6,184,911 B1 2/2001 Tombs
6,224,978 B1 5/2001 Chen et al.
6,228,549 B1 5/2001 Lambert et al.
6,232,026 B1 5/2001 Lambert
6,342,273 B1 1/2002 Handels et al.
6,352,806 B1 3/2002 Dalal
6,393,226 B1 5/2002 Charlebois et al.
6,424,364 B2 7/2002 Gundlach et al.
6,526,247 B2 2/2003 Stelter et al.
6,589,703 B2 7/2003 Stelter et al.
6,608,641 B1 8/2003 Alexandrovich et al.
2001/0055723 A1 12/2001 Stelter et al.
2002/0168200 A1 11/2002 Stelter et al.
2003/0091921 A1 5/2003 Stelter et al.
2003/0111010 A1* 6/2003 Shibata ..... 118/244
2003/0175053 A1 9/2003 Stelter et al.
2003/0207193 A1* 11/2003 Meyer et al. ..... 430/122

OTHER PUBLICATIONS

Ulrich O.A., Walkup, L.E. and Russel, R.E., Proc. Tech. Assn. Graphic arts, pp. 130-138, 1954.
"Introduction to Magnetic Material" by B.D. Cullity, published by Addison-Wesley Publishing Co., 1972, p. 18.

* cited by examiner

POWDER AREA DENSITY VS. WEB SPEED

POWDER AREA DENSITY VS. DEPOSITION VOLTAGE

LOG PLOT OF
POWDER AREA DENSITY VS. WEB SPEED

LOG PLOT OF POWDER AREA DENSITY D0-D VS. 1/(WEB SPEED)

POWDER AREA DENSITY VS. WEB SPEED

VOLTAGE

POLYESTER RECOMPOUNDED WITH E84

POWDER COATING APPARATUS AND METHOD OF POWDER COATING USING AN ELECTROMAGNETIC BRUSH

CROSS REFERENCE TO RELATED APPLICATIONS

This is a 111A application of Provisional Application Ser. No. 60/551,464, filed Mar. 9, 2004, entitled POWDER COATING APPARATUS AND METHOD OF POWDER COATING USING AN ELECTROMAGNETIC BRUSH by Eric C. Stelter, et al.

BACKGROUND OF THE INVENTION

The invention relates to the field of powder coating. More particularly, the invention relates to a method and apparatus for powder coating. The invention also relates to the production of coatings with multiple layers, combined coating and printing operations on a variety of substrates, and in particular combined coating and printing operations.

The coatings industry has long used utilized liquid coating processes and apparatus, with coatings being applied by spraying or rolling upon a target object. This technology has been used for functional coatings, such as for pipe and reinforced steel bar (rebar), for example.

For several decades, however, the coating industry has increasingly adopted powder coating technology in place of conventional liquid coatings. The preference for powder has occurred to realize environmental and other advantages of powder coatings.

Instead of being suspended in a liquid medium, such as a solvent or water, and applied as a liquid to an article to be coated, a powder is applied dry, i.e., in a granular form. Consequently, a powder coating contains no solvents and emits essentially no volatile organic compounds (VOC's). In addition, venting, filtering, and recovery of solvents are avoided with powder coating.

Powder coating materials are typically applied to conductive substrates by means of spray guns, using an electrostatic deposition technique. The powder, entrained in an airflow and corona or tribo-charged before application, is directed at the conductive substrate.

Other electrostatic deposition techniques are also known, such as that using a fluidized bed and that using a cloud chamber, although electrostatic spraying is the dominant technique used in the industry.

After a substrate is coated according to known electrostatic deposition techniques, the powder coating is cured on the substrate, most typically using an oven or other energy source where the powder is heated to form a final film, or by exposure to chemical vapors. It is an objective to create a continuous final film on the substrate.

However, when relying upon present-day electrostatic apparatus and methods of using such apparatus, uneven coatings can result, which can then require the application of an undesirably thick coating to ensure that the substrate is completely coated in view of such unevenness or non-uniformities.

The application of charged powders or toners to substrates or receivers by means of an electric field is also performed by processes commonly known in electrography and particularly in photocopying technology, laser printer technology, or ionography (these application processes are elucidated in, for example, L. B. Schein, "Electrography and Development Physics", Laplacian Press, 1996, the disclosure of which is incorporated herein by reference).

SUMMARY OF THE INVENTION

The present invention comprises a method and apparatus for applying powder coatings to a substrate either directly or by intermediate transfer using a magnetic brush with a rotating magnetic field.

BRIEF DESCRIPTION OF DRAWINGS

The foregoing and additional features and advantages of the invention will be better understood by means of the following description, presented with reference to the attached drawings showing, by way of non-limiting examples, how the invention can be carried out, and in which:

FIG. 2 is an enlarged view of the electromagnetic brush of the developer system of FIG. 1;

DETAILED DESCRIPTION OF THE INVENTION

Figure 1B:
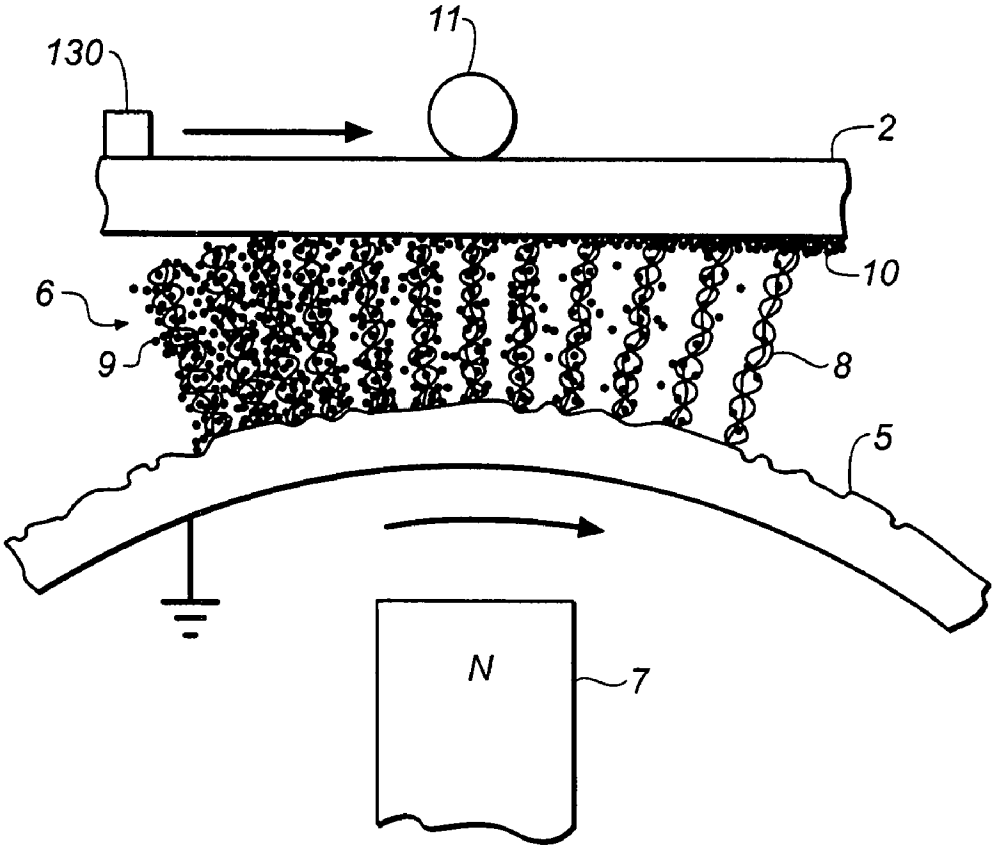
FIG. 1B is an enlarged view of the electromagnetic brush of the developer system of FIG. 1.

Various aspects of the invention are now presented with reference to the drawings, which are not drawn to any particular scale, and wherein like components in the numerous views are numbered alike. The present invention comprises a method and apparatus for applying powder coatings to a substrate either directly or by intermediate transfer using a magnetic brush. Further, the invention relates to improvements in the technology, including application of the technology to a wider array of applications, optimized setpoints for the method and apparatus, and particular modifications to the technology for continuous, uniform coating applications.

In a more specific application of the invention, the invention relates to a powder coating apparatus and method that employs an electromagnetic brush comprising at least one rotating magnetic field, preferably derived by using a rotating magnetic core, for depositing powder particles onto a target object, particularly a substrate that can be conductive, insulative, or ferromagnetic. The deposition surface of the substrate to be can be smooth, rough, or irregular. The substrate can be in contact with the magnetic brush or at a separation distance so that it is not in contact with the magnetic brush. Coatings consisting of one layer of material, or multiple layers of the same or of different materials can be produced in this manner.

In another embodiment, the invention relates to depositing particles from a magnetic brush onto an intermediate transfer member with a thin, hard, non-conductive overcoat and subsequently transferring the particles from the intermediate transfer member onto a substrate. Coatings consisting of one layer of material, or multiple layers of the same or of different materials can be produced in this manner with minimal cross-contamination between applicators.

In an additional embodiment, the invention relates to combined coating and printing operations, in which an image composed of charged particles is deposited onto a substrate, on which a powder coating or other undercoat has been deposited, which image can be overcoated with another image or with a layer of charged particles. Uniform coatings of particles may be deposited directly with a magnetic brush or deposited indirectly, using a magnetic brush to deposit charged particles to an intermediate transfer member with the preferred characteristics and then transferring the layer of charged particles to the substrate. Images can be transferred from a photoconductor to the substrate, or from a photoconductor to an intermediate transfer member and subsequently transferred to the substrate from the intermediate transfer member or transfer medium. Electrostatic masters or ionographic surfaces may be used instead of a photoconductor to produce the image. Elements of the invention can be used in combination with known coating and printing operations including ink jet printing, flexo printing, varnishing, offset printing, and the like. For example, an ink receptive powder coating can be deposited onto a receiver and subsequently imaged by an ink jet print head. An aspect of the invention is directed to the aforementioned adaptation of rotating electromagnetic brush technology, which is known to be used in traditional electrophotographic office printing processes, to applications outside of such traditional processes which typically make marks on paper or on plastic overhead transparencies.

The medium to be coated is herein referred to as a substrate, receiver or web. The substrate to be coated according to the invention can include metallic substrates and magnetic metallic substrates, in particular, such as iron. Coatings applied to non-metallic surfaces, including paper, cardboard, corrugated stock, wood substrates, cloth, and plastic films, for example, are also intended to be encompassed by the invention. Substrates comprise uniform, flat sheets of material, material having rough surfaces or non-planar surfaces, wires, and material with perforations. Powder will be applied by the magnetic brush to surfaces where there is an enabling electric field from the applicator to the surface, such as the surface of a wire, the edge of thick material, or the inside of a perforation.

In a particular exemplary implementation, the apparatus of the invention includes: a reservoir of charged powder particles in the presence of hard carrier particles; a movable receiver for receiving charged powder particles from the reservoir of charged powder particles; a conveyance device to feed the charged powder particles with carrier particles from the reservoir to a position proximate the movable receiver and to deposit the charged particles and substantially no visible or tactile carrier onto the movable receiver; the conveyance device including a rotatable or movable shell, a rotatable magnetic core, an electric field between the conveyance and the receiver resulting in motion of coating powder particles to the receiver; and the movable receiver.

The electric field can be produced by bias voltages or static charges applied to the conveyance, to the receiver, or to adjacent electrodes. Combinations of these elements can be used to provide an electric field driving the deposition of the powder to the receiver. A static field or a field with a dynamic, time varying component can be used. For example, a conveyance consisting of a conductive toning shell can be biased with a DC voltage and a superimposed AC voltage. The receiver can either be biased or at ground potential, can have an electrode or grounded conductor adjacent the opposite side, or can be electrostatically charged on either the side facing the developer, the reverse side, or on multiple surfaces.

According to an exemplary implementation, a process of the invention includes: charging powder particles in a reservoir in the presence of hard magnetic carrier particles to cause the powder particles to adhere to carrier particles to form a developer; or more preferably, pre-charging powder particles and mixing the charged particles with magnetic carrier particles to cause the powder particles to adhere to carrier particles to form a developer; conveying the developer from the reservoir to a position proximate a receiver by means of a roller having a rotatable shell and a rotatable magnetic core with an electric field established between the rotatable shell and the receiver, and depositing the powder particles of the developer, with substantially no visible or tactile carrier particles, onto the moving receiver and thereby forming a layer of the powder particles on the receiver. The magnetic core can rotate in either a countercurrent direction relative to the receiver, or in a co-current direction. If the substrate is not in contact with the magnetic brush nap, co-current rotation of the magnetic core is preferred. Additionally, it is preferred that the toning shell have a non-conductive coating.

Figure 5:
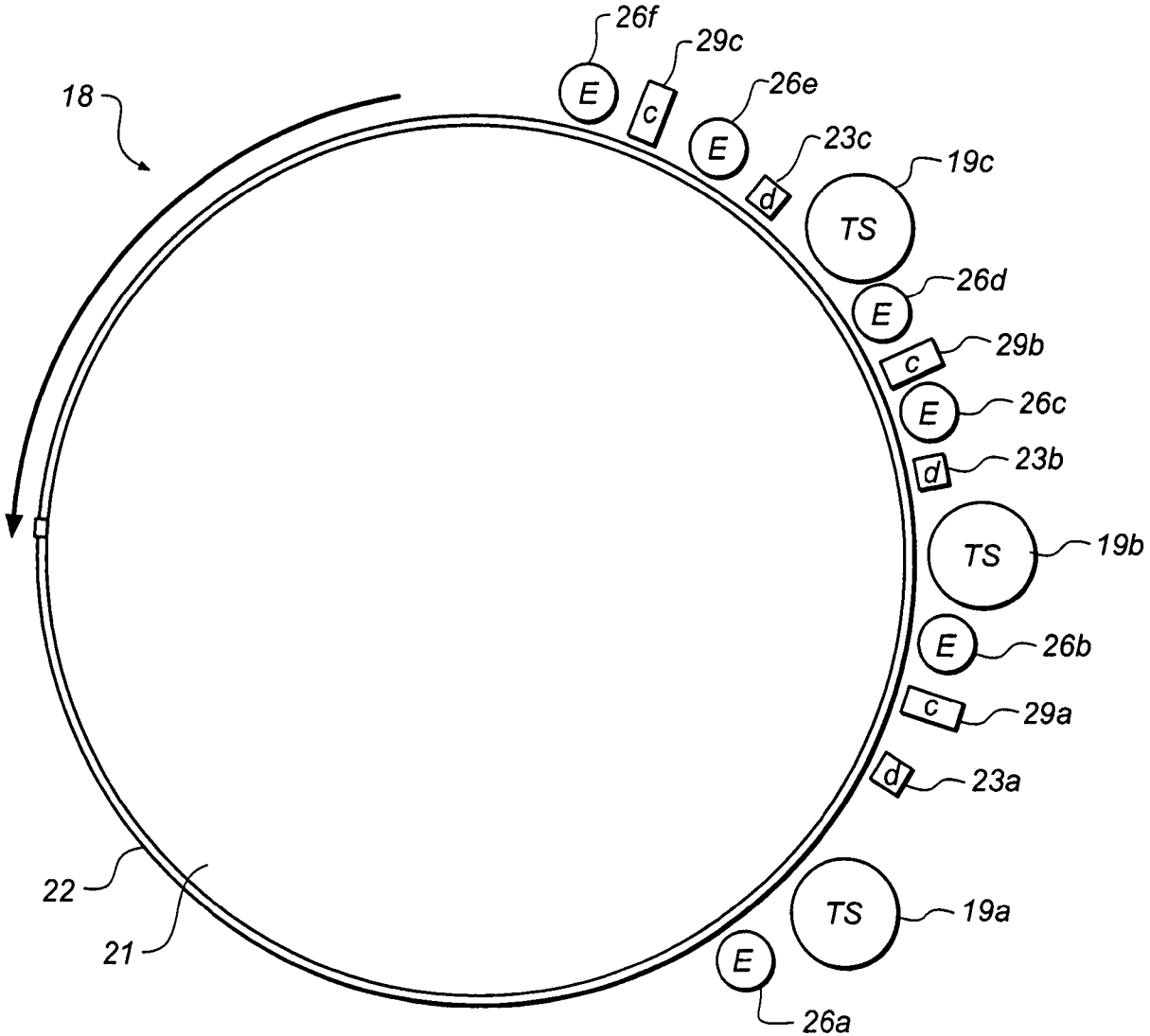
FIG. 5 is a schematic side view of a second exemplary implementation of a powder coating apparatus according to the invention.

The electric field between the toning shell and receiver is controlled by a CPU, for example, by means of an adjustable bias voltage applied to the toning shell, to produce a coating with a controlled thickness based on measurements of thickness, optical absorbance, or voltage of the charged powder. Changes in the thickness of a uniform coating can occur due to fluctuations in the speed of the substrate or of the applicator, changes in the spacing between the substrate and applicator, changes in the electric field driving deposition, and changes in the powder charge. These changes in thickness of the coating can be due to gear noise, dimensional irregularity of components causing changes in spacing, and other causes. These errors can be corrected by adding a correction signal to the bias voltage. This can be done by means such as: measuring thickness fluctuations within a characteristic frequency range and feeding a correction signal back to the applicator; by feeding a varying test voltage to the applicator, preferably at the expected fundamental frequency and expected amplitude to compensate for expected thickness variations in the coating, and adjusting the amplitude, phase, and spectral components of the test voltage to minimize variation in the output; or by having a second applicator to compensate for variations in the coating produced by the first applicator, using a second thickness sensor after the second applicator. Multiple applicators in a configuration that can be used in this manner are shown in FIG. 5.

An exemplary method of measuring thickness utilizes the analog output of a reflective laser displacement device. The analog voltage, proportional to distance from the coating powder to the sensor, will be used as a control signal to set the shell potential in this closed loop system. Other means of measuring thickness can be used. For example, thickness or mass area density can be determined by electrostatic voltage measurements. The voltage of a layer of uniformly charged powder is approximately proportional to the thickness squared, or to the mass area density squared, as shown in FIG. 2*f*. The charge deposited on the substrate per unit area Q/A can be calculated from measurements of the electric current I to the developer station during deposition, the speed of the substrate s, and the width of the coating w, as $Q/A = I/(sw)$. This charge density per unit area Q/A equals the charge density per unit volume $\rho_Q$ times the coating thickness T, or $Q/A = \rho_Q T$. The voltage of the coating for a conductive, grounded substrate, as noted earlier, is proportional to the thickness squared, and more exactly, $V \propto \rho_Q T^2/2$. Consequently, for a conductive, grounded substrate, the thickness T of the coating is proportional to V/(Q/A), with the proportionality constant depending on the relative dielectric constant and packing density of the powder material as deposited. The voltage V of the coating can be measured by electrostatic voltmeters or electrometers. The developer station current can be measured by a number of means, including: the voltage drop across a resistor; a current to voltage converter, such as an LED driving a photocell; inductively, using a Hall effect sensor or other means; and indirectly, such as by counting the number of times the output capacitor of a switching power supply is recharged per second. Any of these means, or other means known to those skilled in the art can be used to calculate the developer current, which, with knowledge of the coating width and process speed, can be used to calculate the charge deposited per unit area on the substrate. For a cured coating, reflective laser displacement devices can be used to measure thickness. Electrostatic methods can also be used. For a non-conductive or semiconductive coating that has no net electric charge transported at a known substrate speed, the surface of the coating can be charged at a known charge per unit area. The thickness of the coating can be determined from the resulting voltage measured at the surface, the charge per unit area, and the dielectric constant of the coating, with corrections for the substrate material, undercoat, or precoat, or for any voltage initially present. From the thickness determined by either of these thickness measurement techniques, or from other commonly used thickness measurement techniques, and from the density of the coating material, the mass area density of the coating can be calculated.

When a coating is being deposited, powder can be fed from a powder reservoir to the developer reservoir at an average feed rate equaling the desired rate of application. The powder concentration in the developer reservoir may be controlled by a processor or CPU that controls replenishment from a powder reservoir utilizing an algorithm that uses a magnetic toner monitor as known in the art, or by an algorithm that uses measurements of the voltage and thickness of the coating to control replenishment.

For powder that is tribocharged on the carrier, the powder concentration is controlled by an algorithm that uses measurements of the voltage of the charged powder layer and the powder deposition thickness or mass area density. For a given deposition thickness, if the voltage exceeds expected values, the particle concentration in the reservoir is increased by increasing the feed rate of powder to the reservoir. If the voltage is lower than expected, the particle concentration is allowed to decrease by decreasing the feed rate of powder to the reservoir. This algorithm is based on previously mentioned observations that, for constant average charge density per unit volume, the voltage at the surface of a layer of charged particles is approximately proportional to the thickness squared and to the average charge of the particles.

A magnetic device for scavenging carrier from the receiver is provided downstream from the development station. Preferably, means are also provided for biasing the toning station to remove carrier to this external scavenger or to a device in contact with the developer material in the development sump of the development station. Other means may be provided for removal of carrier from the toning station, such as openings in the developer reservoir from which carrier can be removed, and preferably augers for removing carrier. Carrier is periodically replaced in the developer sump by the operator, by automatic means, or by mixing carrier with the powder at a known ratio.

A backup bar or electrode 11 is provided in part to control the spacing of the receiver from the applicator, as shown in FIG. 1. As is known in the art for electrophotographic printers, engagement of the backup bar to the applicator is under CPU control. The spacing between the backup bar and the applicator is increased when it is not desired to deposit material on the receiver. For powder coating applications, the spacing between the backup bar and the applicator can be increased when it is not desired to coat. This condition can occur during setup of the coating machine or during passage of sections of the substrate that are not to be coated because the substrate material is unusable, such as portions of the substrate or receiver containing splices or portions that are damaged. These unusable sections can be detected by a substrate detector. The substrate can be removed from proximity with the applicator by auxiliary rollers if the substrate does not move from proximity to the applicator when the backup bar is moved. For instance, the backup bar can be disengaged from the applicator if splices or damaged portions of the substrate are detected or observed by an operator that are additionally potentially harmful to the applicator. In addition, a moveable applicator shield can be utilized.

Aspects of this process can be used either for direct deposition of the powder from the magnetic brush to the receiver, which is the preferred embodiment, or for deposition of the powder from the magnetic brush to an intermediate transfer member or medium and sequentially to the receiver. One or more intermediate transfer members can be used. These intermediate transfer members can be used with backup bars, and moveable station shields in conjunction with a receiver.

One or more magnetic brush applicators can be used to produce a layer of a single material, or to produce a multilayered coating in which layers of different materials are deposited one on the other. The single material may be particles that are a mixture of different components. For example, the material may comprise particles composed of a binder material that contains nanoparticles that are mixed into the binder material. Alternately, the material may comprise particles composed of a binder material with a surface coating of nanoparticles. The material of the binder and the material of the nanoparticles are chosen to have different properties. Coatings consisting of multiple layers can also be produced, with adjacent layers having different properties. For example, layers of primarily polymeric materials can be interspersed with layers of rigid materials, such as ceramic powders, for heat and scratch resistance. Multiple layers can be deposited by the rotating magnet powder applicator by serial deposition from multiple stations or by repeated passes over one station. In the powder paint application, this yields thicker coatings, or combinations of undercoats, base coats, and overcoats. Corrosion resistance can be realized in this fashion, as well as protective and aesthetic topcoat features. Surface variations from matt to high gloss can be achieved with the appropriate paint formulation.

The multiple layer capability is extensible beyond paint or toner layers to composite or functional layers. Examples include A) Metal or metal-like finishes in which small particles, metal flakes or metallized flakes are compounded with resin to give powders that can be delivered by the rotating magnet powder applicator. With appropriate coating or functionalization, these particles will level to produce a metallic or mirror finish. Protective overcoats can then be applied. Pearlescent and "flop" type particles can also be components of such layered coating packages.

B) Coatings consisting of binder particles with a nanoparticle coating. The binder may be chemically inert and the nanoparticle coating can consist of a catalyst. In this case, the function of the coating is to disperse a catalyst such as palladium or platinum. Preferably, to aid dispersion, the binder particles and nanoparticles tribocharge to opposite polarities when mixed.

C) Composite coatings where a binder is combined with a filler or reinforcing agent as a single lamina or multiple laminate. Polymeric binders can be laid down with the applicator brush followed by filler sheet or roll (for example, fiberglass sheet) and a second application of a binder of the same or different composition on top of the filler. The package is then heated to yield a consolidated composite. The filler may also be comprised of powder that is deliverable by the rotating magnet brush applicator. Inorganic or organic fibers can be compounded into resin binder and the pulverized powder bias developed. The filler may also included inorganic or metallic particulates with advantageous thermal, structural or electronic properties. These could be functionalized to give the appropriate tribocharging behavior, or compounded with binder and processed as a powder paint. As examples, i) ferrites as microwave absorbers ii) alumina and zirconia powders as insulators iii) phosphors for intensifying screens D) layers that are reactive or can be reacted. It is anticipated that unique materials can be prepared from the combination of precursor layers. The reactions can be initiated or assisted with photon or thermal energy. For example, i) adjacent binder layers which cross-link upon UV illumination.

ii) layers containing inorganic components or precursors to the components that upon thermal treatment react to form a layer of pure or multiphase solid state layer. Such reactions require the appropriate substrates and atmospheres, and can be facilitated by incorporation of fluxes and mineralizers.

E) image-wise application of layers where any of the above layering approaches is combined to yield three-dimensional or functionally heterogeneous structures. Applications include:

i) electronic circuitry, including active and passive devices, connectors and electrodes that are laid down by multiple stations containing powders containing the appropriate materials or precursors.

ii) reactive chemistries in which a layer is treated in an image-wise manner to generate the desired performance, for example, a conductive pathway or a luminescent image by laser heating, or a resist layer is imaged by masking and photon exposure.

iii) combinatorial layering for large scale examination of properties. The rotating magnet brush applicator is amenable to producing physically large combinatorial matrices so that macroscopic measurements can be made on the processed package.

The invention can be used to provide an undercoat or an overcoat for toner images, for ink jet images, or for images produced by other conventional printing means that are transferred to the receiver. If multiple layers of different materials are deposited, each layer can be charged, preferably with corona, to reduce cross contamination caused by powder from a first layer being removed and mixed into the developer of a toning station depositing a second layer.

An auxiliary aspect of the invention is to use an intermediate transfer member or medium, which can be a belt, drum (cylindrical), or roller (cylindrical), consisting of a thick compliant layer and a relatively thin, hard, insulative overcoat or release layer, to transfer a toner image or uniform layer of charged particles to a receiver, and particularly to a conductive receiver. The release layer may include a synthetic material such as a sol-gel, a ceramer, a polyurethane or a fluoropolymer, but other materials having good release properties including low surface energy materials may also be used. The release layer may have a Young's modulus greater than 100 MPa, more preferably 0.5-20 GPa, and a thickness preferably less than 0.3 mm, more preferably in a range of 1-50 micrometers and most preferably in a range 4-15 micrometers. The release layer has a bulk electrical resistivity preferably in a range $10^7$-$10^{13}$ ohm-cm and more preferably about $10^{10}$ ohm-cm. The intermediate transfer member may also be patterned, particularly with a relief pattern similar to a flexo plate so that the outermost portion of the member receives a powder coating that is then transferred to the receiver. This imagewise coating can be transferred directly to the receiver, or transferred to another intermediate with a uniform surface, and subsequently transferred to the receiver. For an imagewise coating, a portion of the receiver is coated, and a portion is not coated. The imagewise coating can be used in the production of cans or other items that are to be cut from a web and sealed or welded, where the coating may interact with or interfere with the sealing or welding process.

In particular, the invention is directed to the adaptation of such processes and uses two-component magnetic development with a rotating magnetic core as a powder deposition process for non-traditional substrates such as metal, plastic, and glass. Toner particles, or more broadly, the electrically charged particles or powders that are used with two-component or mono-component development processes can also be used, according to the invention, as a coating powder that has functions other than that of providing a visible or readable image. Using the present invention, these coatings can be applied at high process speeds in uniform layers with a wide range of thickness. Examples include protective coatings on metal, primer coatings on metal, hydrophobic areas of printing plates, and resists for electrical circuit manufacturing.

Electrographic printers and copiers typically employ a developer, usually having at least two components, which include resinous, pigmented toner particles and magnetic carrier particles to which the toner particles adhere. Other components can also be added, as described below, depending upon the application.

Electromagnetic Brush Development Station

Figure 1A:
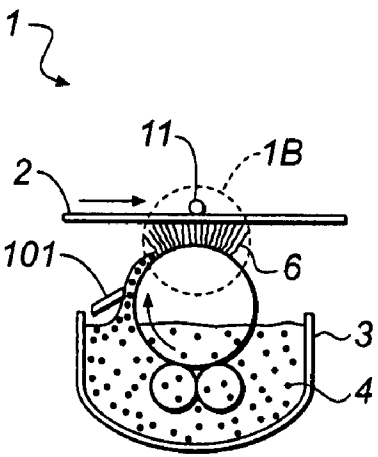
FIG. 1A is a schematic view of the developer system for applying the powder coating onto a substrate.

FIGS. 1A and 1B schematically show an exemplary view of a development station 1 that can be used in the invention for applying a powder coating to a substrate 2. For the purposes of this invention, the terms development station, toning station, powder applicator, and the like are used interchangeably.

The term "substrate" is used herein in a generic sense and is not intended to be limiting to any particular target or article to be coated. For example, the invention is intended to enable coatings on metal, glass, paper, cloth, wood, and plastic including packaging and materials other than overhead projector film. The substrates may have smooth surfaces, rough surfaces, perforated surfaces, curved surfaces such as wires, balls or cylinders or the like, screen type surfaces such as those used in screen doors, etc. These materials may be in the form of discrete objects or a continuous web.

The coating powder particles, which may include toner, provide a dry coating on the substrate, which is later cured to fix it upon the substrate. Applicants have discovered that many apparatus and processes applicable to dry toner printing processes are also applicable to powder coating processes. Therefore, for the purpose of this description, the terms coating powder, powder coating particles, and toner may be used interchangeably.

The magnetic brush development system shown in FIGS. 1A, 1B and 2 operates generally according to the description given U.S. Patent Application Publication No. 2002/0168200 and other examples of magnetic brush systems such as those disclosed in U.S. Pat. Nos. 4,473,029, 4,546,060, and 4,602,863. United States Patent Application, all of which are hereby incorporated by reference as if fully set forth herein.

The relative sizes of the rollers, drum, magnetic brush, magnets, and spacing of components of the development system 1 in FIGS. 1A, 1B and 2 is not shown to scale, for convenience in understanding this description. In addition, although the substrate is shown to be positioned above the developer reservoir and above the magnetic brush, it is also contemplated according to the invention that the components of the apparatus can be placed in other relative positions and orientations.

FIG. 2 illustrates a partial view of a rotatable electromagnetic brush development system, that utilizes hard magnetic carrier particles and a rotatable magnetic core to provide a rotating magnetic field which deposits powder particles onto a substrate to be coated. As mentioned above, the mixture of coating powder particles and hard carrier particles is called developer, analogous to the electrophotographic art With further reference to FIGS. 1A and 1B and to the enlarged view provided by FIG. 2, according to the invention the toner, i.e., powder particles, are mixed in a reservoir 3 with magnetic carrier particles with which they become electrostatically adhered to create a developer 4 contained within the reservoir 3.

A conductive toning shell or drum 5 is used for moving the developer 4 from the reservoir into proximity with the substrate 2 (or into proximity of the imaging member in the electrophotographic art). When a single toning shell is used, the shell may rotate in a direction such that its peripheral portions pass the development zone in a direction co-current with the photoconductor's moving direction. However, the toning shell 5 can move in the same direction as the substrate 2, can move in the opposite direction, or can be stationary. For certain applications, the toning shell moves slowly in the direction of the substrate, with a surface speed of less than 10% of the substrate speed.

The toning shell includes a multi-pole magnetic core, having a plurality of magnets 7, one of which is shown in FIG. 2, that may be fixed relative to the toning shell or that may rotate, such as in the opposite direction of the rotation of the shell. However, in some instances, the rotation of the core may be in the same direction as the receiver. The advantages of a rotating core magnetic brush include a high deposition rate and a uniform coating.

As seen in FIGS. 1A and 1B, the developer 4 is entrained onto the toning shell 5 and the toning shell rotates the developer into proximity with the substrate 2 at a location where the receiver and the toning shell are in closest proximity, referred to as the "toning nip." In the toning nip, the magnetic brush 6 composed of the carrier component and the toner component of the developer 4 preferably contacts or is in close proximity to the substrate 2 and directly coats the substrate. The coated substrate is the output of the process and its finished product. In contrast, in electrophotographic imaging apparatus, from which the technology of the invention is adapted, instead of being deposited onto the substrate, the toner is applied to a photoconductive imaging member, prior to being transferred directly to a sheet of paper or other receiver on which the toner is fused to create the final image. This receiver is the output of the process and its finished product. It is also known in the electrophotographic art or electrographic art to apply toner to a photoconductor in an image-wise fashion, transfer the toner to an intermediate transfer member, and to transfer the toner to the receiver, on which it is fused to form the final image. It is also known in the electrophotographic art to transfer toner to an imaging member that is not a photoconductor, but capable of retaining a spatially-varying electrostatic image created by ionography, for example. An electrographic master can also be used as an imaging member that contains permanently conductive areas that are used to attract or repel toner.

Development via the magnetic brush 6 occurs in the following manner, which, of course, is known in the art of electrophotography. In the toning nip, the magnetic carrier component of the developer forms a "nap," as shown in FIG. 1B as 8, similar in appearance to the nap of a fabric, on the toning shell 5, because the magnetic carrier particles form chains of particles 8, as shown in FIG. 2, that rise vertically from the surface of the toning shell 5 in the direction of the magnetic field. The nap height is maximum when the magnetic field from either a north or south pole is perpendicular to the toning shell. Adjacent magnets in the magnetic core have opposite polarity and, therefore, as the magnetic core rotates, the magnetic field also rotates from perpendicular to the toning shell to parallel to the toning shell. When the magnetic field is parallel to the toning shell, the chains collapse onto the surface of the toning shell and, as the magnetic field again rotates toward perpendicular to the toning shell, the chains also rotate toward perpendicular again. Thus, the carrier chains appear to flip end over end and "walk" on the surface of the toning shell and, when the magnetic core rotates in the opposite direction of the toning shell, the chains walk in the direction of the travel of the substrate.

As the substrate 2 continues advancing in the direction of the rotation of the toning shell 5, the dry powder or toner 9, is deposited onto the substrate to form the coating 10. If the substrate is not conductive, a bias electrode 11 can provide such charge which has an effective voltage to strip the toner particles 9 from the chains of carrier particles 8. Alternately, electric charges can be applied to the substrate by corona, roller, ion deposition, or other means. The strength of the electric field and the voltage between the rotatable shell 5 and the substrate 2 determines the amount of toner 4 that is developed, i.e., the amount of toner that is deposited upon the substrate. Electrode 11 may also serve as a backing bar to provide support for the substrate to keep it positioned properly. To this end, the bar 11 may or may not be biased when serving as a support mechanism. The bar may be moved as may be necessary during operation. For instance, the bar 11 may be moved away from the substrate if the substrate has protrusions which may damage the development station or bar as the protrusion approaches the development station 1 as the substrate 2 is moved. The bar 11 may be positioned closer to or against the substrate after the protrusion passes by the development station 1.

While the magnetic brush 6 is established, the toner particles adhere to the carrier particles by means of electrostatic forces and surface forces. During deposition of the toner particles onto the substrate, the adhesive forces between the toner and carrier particles are overcome by the strength of the applied electric field. For magnetic brush technology, agitation of the developer by the rotating magnetic fields increases the deposition rate of toner onto the substrate. The deposition rate for development systems using a rotating magnetic brush is greater than that for development systems using stationary magnetic fields.

As shown in FIG. 1A, a doctor blade or skive 101 is positioned adjacent the toning shell 5 at the upstream side of the magnetic brush 6 at a distance from the shell that determines the amount of developer 4 that is entrained onto the surface of the toning shell and is available to the magnetic brush 6.

Bias voltages for powder coatings are not constrained to the range known to be used for photoconductors and can exceed 1000 volts in magnitude, preferably less than 7000 volts, 10,000 volts, or the onset of corona.

The magnetic brush 6 can be used with the carrier and toner/powder particles in contact with the substrate 2, as shown in FIGS. 1A, 1B and 2, or it can be used with the carrier not in contact with the substrate. Non-contacting coating tends to reduce the rate at which the toner/powder particles can be deposited on the substrate. However, it has the advantageous properties of reducing scavenging or disturbance of a previously deposited powder layer or image, and it decreases contamination of the developer by previously deposited powders. Non-contact coating also reduces unwanted deposition of carrier particles onto the receiver surface. For non-contact coating, preferably the toning shell and the magnetic core rotate co-current with the receiver.

In establishing the necessary electric field, described above, a DC bias voltage can be used or a bias voltage containing a DC component with an AC component can be used. Bias with both DC and AC components is particularly effective for non-contact coating. Bias with both DC and AC components has also been shown in the electrophotographic art for contact development/deposition to reduce the amount of carrier that is deposited onto the toner/powder coating, and to reduce the effects of variable or non-uniform spacing between the toning shell and the substrate.

As the developer moves out of the toning nip, the field of the rotating magnetic core frees carrier particles from the substrate and pulls them into the developer. The particles are recirculated within the reservoir 3. The alternating magnetic field of the rotating core also demagnetizes ferromagnetic materials, similar to electromagnetic demagnetizers that are powered by AC current. This further reduces the amount of carrier that is deposited onto the substrate.

Passing the coated surface 10 adjacent a scavenger is desirable, according to the invention, to remove any carrier particles that may have become deposited with the toner/powder particles and to ensure that the number of carrier particles per unit area on the coated surface is at an acceptable level. Carrier scavengers are well known in the art and may consist of a permanent magnet and an electrode biased to remove the carrier particles. The electrical bias of the scavenger can have both AC and DC components.

After the toner coating 10, i.e., powder coating 10, on the substrate 2 leaves the area of the development station 1, the coated substrate is delivered to a curing station where the coating is fixed according to any of several processes used in other known electrostatic powder deposition techniques. For example, the coating can be cured by conventional ovens, such as convection ovens, as well as so-called radiation curing, such as ultraviolet (UV), infrared (IR), or electron beam (EB) curing, induction heating of conductive substrates, and combinations thereof. The coating can also be cured by exposure to solvent vapors.

Infrared radiation can be used for achieving a relatively rapid increase in temperature of the powder/toner, thereby causing the powder/toner to flow and cure when subjected to such radiation for a sufficient time without requiring the entirety of the substrate to be heated to cure temperature. Alternatively, infrared can be used as an initial phase to cause the powder/toner to begin to flow so that it is not disturbed in a subsequent exposure, for example, to currents of a convection phase.

Ultraviolet curing has been recently developed for use in the electrostatic coating industry particularly for heat-sensitive substrates and components, such as certain relatively thin paper, cardboard and plastic substrates, in particular. A UV-curable powder toner is used in place of a more conventional thermoplastic toner. In UV curing, the powder is first exposed to sufficient heat, such as from IR radiation, so that the powder is molten when exposed to the UV radiation. Photoinitiators in the coating absorb the UV energy and initiate a series of chemical reactions that rapidly convert the molten film to a solid cured finish.

Apparatus and Methods that May be Implemented in the Practice of the Invention Examples of disclosures of electrographic apparatus which incorporate an electromagnetic brush station, to develop the toner to a substrate (an imaging/photoconductive member bearing a latent image), after which the applied toner is transferred onto a sheet and fused thereon can be found in U.S. Pat. Nos. 4,473,029 and 4,546,060, and U.S. Patent Application Nos. 2002/0168200 and 2003/0091921. Similarly, according to the invention, the powder particles are developed, although preferably directly deposited as described above in connection with FIGS. 1 and 2, to a substrate on which the final coating is subsequently fixed.

U.S. Pat. Nos. 4,473,029, 4,546,060, and 4,602,863 provide a description of magnetic brush technology using a rotating magnetic core for use in electrographic development apparatus. U.S. Pat. Nos. 4,473,029, 4,546,060, and 4,602,863, and U.S. Patent Application Publication Nos. 2002/0168200 and 2003/0091921 are hereby incorporated by reference as if fully set forth herein.

U.S. Pat. Nos. 6,526,247 and 6,589,703 and U.S. Patent Application Publication Nos. 2002/0168200, 2003/0091921 and 2003/0175053 provide additional description of magnetic brush technology using a rotating magnetic core for use in electrographic development apparatus. An essential feature of magnetic brush technology using a rotating magnetic core is that the magnetic field in the development zone has a rotating magnetic field vector. U.S. Pat. Nos. 6,526,247 and 6,589,703 and U.S. Patent Application Publication Nos.

2002/0168200, 2003/0091921 and 2003/0175053 are hereby incorporated by reference as if fully set forth herein.

U.S. Pat. No. 5,400,124 provides a description of magnetic brush technology using a rotating magnetic core and a stationary toning shell for applying toner to an electrostatic image. U.S. Pat. No. 5,966,576 provides a description of an alternate configuration of toning station also having rotating magnetic field vectors, in which a plurality of rotatable magnets are located adjacent to the underside of the development surface of the applicator sleeve to move developer material through the development zone. U.S. Pat. No. 5,376,492 discusses development using a rotating magnetic core and an AC developer bias. U.S. Pat. Nos. 5,400,124, 5,966,576, and 5,376,492 are hereby full incorporated by reference as if fully set forth herein.

U.S. Pat. No. 5,307,124 discusses pre-charging toner before feeding into the developer sump containing partially depleted two-component developer material. U.S. Pat. No. 5,506,372 discusses a development station having a particle removal device for removing aged magnetic carrier to compensate for the addition of fresh carrier.

Depositing multiple layers of toner on a substrate by direct deposition from a magnetic brush includes U.S. Pat. Nos. 5,001,028 and 5,394,230, which discuss a process for producing two or more toner images in a single frame or area of an image member using two or more magnetic brush development stations with rotating magnetic cores. In this process, a region of an electrostatic receiver is developed with a first toner of a first polarity and then the receiver with a deposit of charged toner particles is passed through a second magnetic brush using a second toner of the first polarity, which deposits the second toner on the receiver. U.S. Pat. Nos. 5,409,791, 5,489,975, and 5,985,499 discuss a process for developing an electrostatic image on an image member already containing a loose dry first toner image with a second toner having the same electrical polarity as the first toner, using rotating magnetic core technology and AC projection toning, where the developer nap is not in contact with the receiver. U.S. Pat. Nos. 5,307,124, 5,506,372, 5,001,028, 5,394,230, 5,409,791, 5,489,975, and 5,985,499 are hereby incorporated by reference as if fully set forth herein.

For depositing multiple layers of toner on a substrate by transfer of the toner from an intermediate transfer member, intermediate transfer medium, or ITM, U.S. Pat. No. 5,084,735 and U.S. Pat. No. 5,370,961 disclose use of a compliant ITM roller coated by a thick compliant layer and a relatively thin hard overcoat to improve the quality of electrostatic toner transfer from an imaging member to a receiver, as compared to a non-compliant intermediate roller. Additional applications of hard overcoats on intermediate transfer members are disclosed in U.S. Pat. No. 5,728,496 and U.S. Pat. No. 5,807,651, which describe an overcoated photoconductor and overcoated transfer member, U.S. Pat. No. 6,377,772, which describes composite intermediate transfer members, and U.S. Pat. No. 6,393,226, which describes an intermediate transfer member having a stiffening layer. U.S. Pat. Nos. 5,084,735, 5,370,961, 5,728,496, 5,807,651, 6,377,772, and 6,393,226 are hereby incorporated by reference as if fully set forth herein.

U.S. Pat. No. 6,608,641 describes a printer for printing color toner images on a receiver member of any of a variety of textures. The printer has a number of electrophotographic image-forming modules arranged in tandem (see for example, Tombs, U.S. Pat. No. 6,184,911). These include a plurality of imaging subsystems to form a colored toner image that is transferred to a receiver member, the transfer of toner images from each of the modules forming a color print on the receiver member which is fused to form a desired color print. U.S. Pat. Nos. 6,608,641 and 6,184,911 are hereby incorporated by reference as if fully set forth herein.

Such a printer includes two or more single-color image forming stations or modules arranged in tandem and an insulating transport web for moving receiver members such as paper sheets through the image forming stations, wherein a single-color toner image is transferred from an image carrier, i.e., a photoconductor (PC) or an intermediate transfer member (ITM), to a receiver held electrostatically or mechanically to the transport web, and the single-color toner images from each of the two or more single-color image forming stations are successively laid down one upon the other to produce a plural or multicolor toner image on the receiver.

As is well known, a toner image may be formed on a photoconductor by the sequential steps of uniformly charging the photoconductor surface in a charging station using a corona charger, exposing the charged photoconductor to a pattern of light in an exposure station to form a latent electrostatic image, and toning the latent electrostatic image in a development station to form a toner image on the photoconductor surface. The toner image may then be transferred in a transfer station directly to a receiver, e.g., a paper sheet, or it may first be transferred to an ITM and subsequently transferred to the receiver. The toned receiver is then moved to a fusing station where the toner image is fused to the receiver by heat and/or pressure.

In a digital electrophotographic copier or printer, a uniformly charged photoconductor surface may be exposed pixel by pixel using an electro-optical exposure device comprising light emitting diodes, such as for example described by Y. S. Ng et al., Imaging Science and Technology, 47th Annual Conference Proceedings (1994), pp. 622-625.

A widely practiced method of improving toner transfer is by use of so-called surface treated toners. As is well known, surface treated toner particles have adhered to their surfaces sub-micron particles, e.g., of silica, alumina, titania, and the like (so-called surface additives or surface additive particles). Surface treated toners generally have weaker adhesion to a smooth surface than untreated toners, and therefore surface treated toners can be electrostatically transferred more efficiently from a PC or an ITM to another member.

As disclosed in the Rimai et al. patent (U.S. Pat. No. 5,084,735), in the Zaretsky and Gomes patent (U.S. Pat. No. 5,370,961) and in subsequent U.S. Pat. Nos. 5,821,972 5,948,585 5,968,656 6,074,756 6,377,772 6,393,226 and 6,608,641, use of a compliant ITM roller coated by a thick compliant layer and a relatively thin hard overcoat improves the quality of electrostatic toner transfer from an imaging member to a receiver, as compared to a non-compliant intermediate roller. U.S. Pat. Nos. 5,084,735 5,370,961 5,728,496 5,807,651 5,821,972 5,948,585 5,968,656 6,074,756 6,377,772 6,393,226 and 6,608,641 are hereby incorporated by reference as if fully set forth herein.

A receiver carrying an unfused toner image may be fused in a fusing station in which a receiver carrying a toner image is passed through a nip formed by a heated compliant fuser roller in pressure contact with a hard pressure roller. Compliant fuser rollers are well known in the art. For example, the Chen et al. patent (U.S. Pat. No. 5,464,698) discloses a toner fuser member having a silicone rubber cushion layer disposed on a metallic core member, and overlying the cushion layer, a layer of a cured fluorocarbon polymer in which is dispersed a particulate filler. Also, in the Chen et al. patent U.S. Pat. No. 6,224,978 is disclosed an improved compliant fuser roller including three concentric layers, each of which layers includes a particulate filler. Additional fusing means known in the art, such as noncontact fusing using IR radiation, oven fusing, or fusing by vapors may also be used. U.S. Pat. Nos. 5,464,698 and 6,224,978 are hereby incorporated by reference as if fully set forth herein.

U.S. Pat. Nos. 5,339,146, 5,506,671, 5,751,432, and 6,352,806 discuss means of forming overcoats on receivers with charged particles in the context of electrographic imaging. U.S. Pat. No. 5,339,146 uses a fusing surface or belt as an intermediate transfer member. This patent discloses mixing a clear particulate material with a magnetic carrier. The clear particulate material is applied using an applicator consisting of a conventional magnetic brush development device. The applicator, using a rotating magnetic core and/or a rotatable shell, moves the developer mixture through contact with the fusing surface to deposit the particulate material on it. An electrical field is applied between the applicator and belt to assist this application. The fusing belt is preferably a metal belt with a smooth hard surface. U.S. Pat. No. 5,506,671 discloses an electrostatographic printing process for forming one or more colorless toner images in combination with at least one color toner image. At each image-producing station an electrostatic latent image is formed on a rotatable endless surface; toner is deposited on the electrostatic latent image to form a toner image on the rotatable surface, and the toner image is transferred from its corresponding rotatable surface onto the receptor element. U.S. Pat. No. 5,751,432 is directed to glossing selected areas of an imaged substrate and, in particular, to creating xerographic images, portions of which include clear polymer for causing them to exhibit high gloss thereby causing them to be highlighted. The clear toner may be applied to color toner image areas as well as black image areas. Additionally, the clear toner may be applied to non-imaged areas of the substrate. In carrying out the invention, a fifth developer housing is provided in a color image creation apparatus normally comprising only four developer housings. U.S. Pat. No. 6,352,806 concerns a color image reproduction machine that includes means for forming an additional toner image using clear colorless toner particles, thereby resulting in a uniform gloss of the full-gamut color toner image.

Additional prior art for electrostatically applied overcoats on images produced by non-electrographic means include: U.S. Pat. No. 5,804,341, which concerns an electrostatically applied overcoat on a silver halide image; U.S. Pat. No. 5,847,738, in which an electrostatic overcoat is applied to liquid ink; and U.S. Pat. No. 6,031,556, which cites an electrostatic overcoat on an image produced by thermal transfer. U.S. Pat. No. 6,424,364 cites use of an electrostatically-applied clear polymer as an undercoat to capture ink jet images which are subsequently fused.

Transfer of charged toner particles to metal substrates, particularly copper or zinc printing plates, from a paper intermediate using electrostatic transfer is disclosed in Sinclair, M., in Printing Equip. Engr. November 1948, p. 21-25. The toner was used as an acid resist for etching. Transfer of charged toner particles to metal substrates from an intermediate using adhesive transfer is disclosed in: Ullrich O. A., Walkup, L. E., and Russel, R. E., Proc. Tech. Assn. Graphic Arts p. 130-138 (1954). The toner was used as an ink-bearing surface.

Other prior art citing functional uses of toner include U.S. Pat. No. 2,919,179 which discusses using toner transferred directly from a photoconductor to a metallic surface for use as an etch resist. Although several distinct applications are discussed, the description is limited, by way of example, to the discussion of printed circuit boards. U.S. Pat. No. 3,413,716 discloses transfer of toner particles from a photoconductor to a metallic surface to form a resist layer for etching inductors. U.S. Pat. Nos. 2,919,179 and 3,413,716 are hereby incorporated by reference as if fully set forth herein.

Rotating magnetic brush technology promises to provide advantages over the conventional electrostatic spray technology and electromagnetic brush technology using a stationary magnetic core, such as providing an increased processing speed and a thinner, yet more even, coat. In addition, unlike conventional spray technology, the use of an electromagnetic brush does not require recovery systems for recycling powder that is oversprayed at the substrate.

Rotating magnetic brush technology is also capable of depositing multiple layers of charged particles on a substrate. These layers may consist of the same composition of material or the layers may be different materials having different properties. Direct deposition of layers of charged particles may be used in a process in which layers of particles or images composed of particles are transferred from an intermediate transfer drum, roller, or web. Some of these layers may be images, or color separations for images, or clear overcoats. Clear overcoats may substantially cover the receiver, or cover only a portion of the receiver.

While electromagnetic brush (EMB) technology has been suggested as an alternative for current electrostatic deposition techniques, it has not yet realized wide acceptance in the coating industry.

Examples of electromagnetic brush are described in U.S. Pat. Nos. 3,202,092, 3,306,193, and 3,504,624 all of which are hereby incorporated by reference. U.S. Pat. No. 4,041,901 (hereby incorporated by reference) discloses an apparatus for electrostatic printing or coating apparatus. U.S. Pat. No. 6,342,273 (hereby incorporated by reference) discloses a process for coating a substrate with a powder coating.

Substrates

As mentioned above, the substrate 2 according to the invention, is to be coated at the electromagnetic brush development station 1. Conductive, semi-conductive, or insulative substrates can be used according to the invention. Substrates can either be a non-magnetic material (such as copper) or a magnetic material (such as iron). Metal, plastic, cloth, and glass substrates can be coated according to the invention. The substrates may have smooth surfaces, rough surfaces, perforated surfaces, curved surfaces such as wires, balls or cylinders or the like, screen type surfaces such as those used in screen doors, etc. These materials may be in the form of discrete objects or a continuous web.

If a non-conductive substrate such as plastic is used, means are required to establish an electric field between the surface of the substrate 2 to be coated and the magnetic brush 6. As mentioned above, an electrode at ground potential or biased with respect to ground can be used if it is situated so that an electric field exists between the toning shell of the magnetic brush 6 and the surface of the substrate 2 to be coated. For example, for a non-conductive web substrate, the web can pass between a grounded electrode 11 and the magnetic brush 6 with biased toning shell 5 so that the electrode is adjacent the back side of the substrate and the side adjacent the magnets is coated.

Alternatively, a non-conductive substrate can be charged using a corona, brush, or other means so that an electric field is established between the magnetic brush and the surface to be coated. The charge can be applied to the surface to be coated or to an adjacent surface, such as the back side of a web. For these examples, the polarity of the coating powder and the direction of the electric field are arranged so that the powder is attracted to the surface to be coated.

Figure 8:
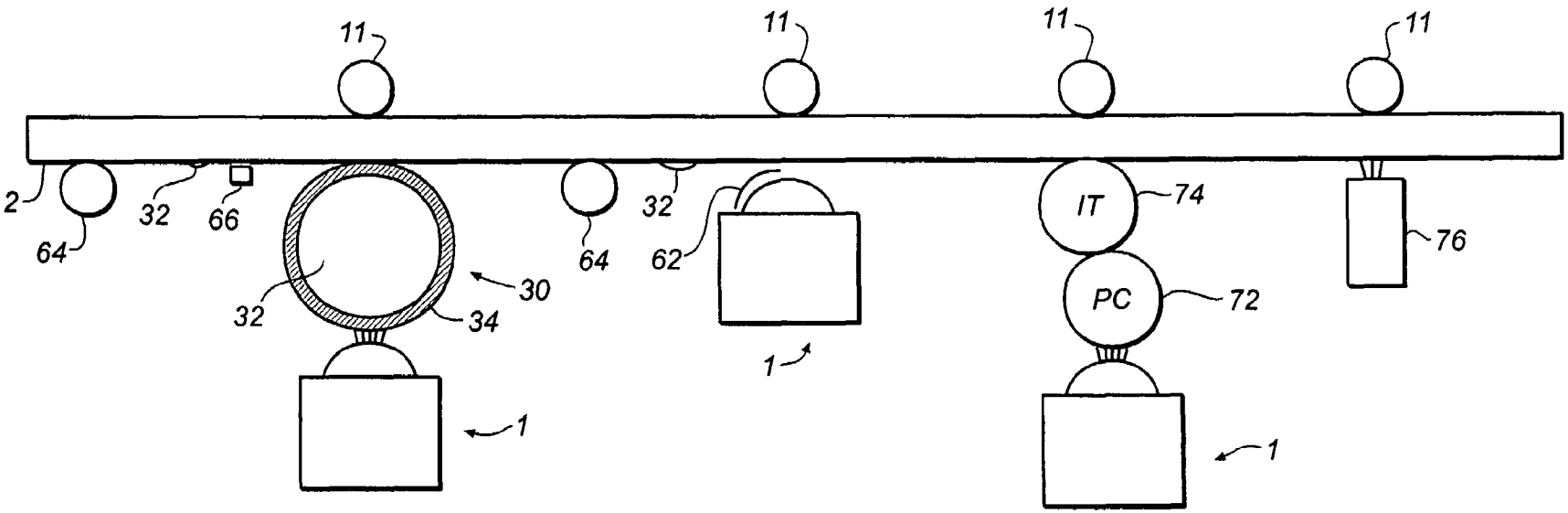
FIG. 8 is a schematic of embodiments of powder coating apparatuses in accordance with the present invention.

Referring now to FIG. 8, in another aspect of the invention, a transfer intermediate 30, such as a drum may be used, particularly if multiple layers of material are to be deposited onto the substrate, if the output requires low amounts of cross-contamination of powder from one toning station to another, or if it is required to have the capability of depositing one or more of the layers of charged particles in an imagewise pattern, as is known in the art of electrophotography. The transfer intermediate may have a dielectric layer. If carrier deposition onto the substrate occurs at unacceptable amounts with direct deposition of the powder from the magnetic brush with a particular powder composition or substrate, an intermediate transfer member can be used to reduce carrier deposition. In this situation, it is preferred that a carrier scavenging device containing a magnet and/or an electrode biased to attract carrier particles is used adjacent the intermediate transfer member to remove carrier particles from the powder layer before the powder is transferred to the substrate. The transfer intermediate can take the form of one or more drums, belts or rollers, particularly elastomeric. Preferably, an intermediate transfer medium or material is used that has a thin, hard overcoat or release layer. More preferably, this overcoat is a nonconducting material or a material with very low conductivity, such as a ceramer. For the non conductive coating on the intermediate transfer member, the thickness should be less than 0.3 mm, and preferably much less than this value. A preferred intermediate transfer roller includes a hollow precision made metal core, preferably of aluminum. A compliant structure, coated on the core includes two layers, i.e., an electrically resistive compliant layer and a thin, hard outer release layer overcoated on the compliant layer. The compliant layer is made of an elastomer, preferably a polyurethane elastomer, the elastomer being doped with sufficient conductive material (such as antistatic particles, ionic conducting materials, or electrically conducting dopants) to have a relatively low bulk or volume electrical resistivity, which resistivity is preferably in a range of approximately $10^7$ to $10^{11}$ ohm-cm, and more preferably about $10^9$ ohm-cm. The preferred thickness of the compliant layer is in a range of approximately 5-15 mm, and more preferably, is about 10 mm. The compliant layer has a Young's modulus in a range of approximately 3.45-4.25 megapascals, and a Shore A hardness in a range of approximately 55-65.

The outer release layer is preferably made of a ceramer, such as described in Ezenyilimba et al., U.S. Pat. No. 5,968,658. Layer 34 has a preferred thickness in a range of approximately 1-50 micrometers, and more preferably, 4-15 micrometers. The resistivity of the release layer is preferably in a range of approximately $10^7$-$10^{13}$ ohm-cm and more preferably about $10^{10}$ ohm-cm. Any suitable outer release layer material may be used.

It is necessary to have a high electric field in the transfer nip to move particles from the intermediate to the receiver. The transfer nip is the contact area of the intermediate and the receiver. Intermediate transfer rollers may be constructed with a conductive inner conductive core 32, such as aluminum or a similar material and nonconductive outer layer or surface 34, such as an elastomeric coating. The core is biased with a voltage that enables transfer of particles from the intermediate to the receiver, using either a constant voltage or a constant current power supply. Elastomers containing conductive additives are used to ensure that charges can move through the coating and produce a large electric field adjacent the receiver. At high process speeds it is necessary that the elastomer be more conductive than for transfer at low speeds, to enable charges to move toward the outer surface of the transfer member and establish a sufficient electric field in the transfer nip while the transfer roller is rotating and additional portions of the transfer roller surface with a powder coating or an image are entering the transfer nip. However, for transfer onto a conductive receiver or substrate, if the conductivity of the elastomer is great enough that the surface of the elastomer is at the same potential as the surface of the receiver, minimal transfer will take place. This is particularly important for conductive, metallic receivers. For conductive substrates and for high process speeds, an intermediate transfer member with a thin, nonconductive coating is required.

In the schematic showing in FIGS. 1A, 1B and 2, the substrate 2 is shown cut-away at its ends. In a particular embodiment, the substrate can be mounted upon a rotatable drum, such as a relatively large diameter drum (see FIG. 5). If desired, the substrate can be made to pass one or more times through the nip of the development station 1 to have one or more layers of powder/toner applied, after which the layer(s) are then fused at a fusing station positioned at a location adjacent the drum.

Alternatively, the substrate can take the form of a web that is trained over one or more support rollers or guides, for example, or the substrate can be fixed upon such a web that is conveyed along one or more development/magnetic brush stations. In a variation of the latter construction, a series of discrete substrates to be coated can be carried by such a web.

As mentioned above, according to the invention, metallic as well as non-metallic substrates can be coated. Among non-metallic substrates, encompassed within the invention are paper, cardboard, corrugated stock, cloth, wood and wood-product films, as well as plastic films. For example, both cardboard and corrugated substrates can be used in the packaging industry.

Among particular applications encompassed by the invention are those that are known to be encompassed by traditional electrostatic deposition techniques, including the coating of coils, cans, pre-cut metal blanks, and medium density fiberboard (MDF) products, the latter of which can take the form of substrates that can be used in cabinetry, furniture, and shelving. Particularly regarding metal substrates, the invention can find application in other areas such as home and industrial appliance housings and metal furniture such as table tops and cabinetry.

Still further, substrates coated according to the invention can be used as primer coatings for subsequent coatings of liquids or powders. Also encompassed by the invention are coated substrates used for electrical insulation, printing plates, resists and photoresists, phosphors and other electrical materials.

In addition, the invention can be used for automotive coatings such as disclosed in U.S. Pat. No. 6,162,861 and coatings on inner tube surfaces such as disclosed in U.S. Pat. No. 6,019,845.

Powder Particles

Toner or powder for use in the invention is, broadly, electrostatically chargeable powder for electrostatic coating systems, monocomponent development systems, or two-component development systems.

Toner or powder particles are polymeric or resin-based. Although thermoplastic resins are useable, thermosetting powders are more preferred. In two-component development, the toner/powder is mixed with magnetic carrier particles to form the developer, as explained above.

The powder/toner particles are created by blending various components, which can include binders, resins, pigments, fillers, and additives, for example, and processing the components by heating and milling, for example, whereupon a homogeneous mass is dispensed by an extruder. The mass is then cooled, crushed into small chips or lumps, and then ground into a powder.

The aforementioned additives incorporated within the powder particles can includes one or more of charge agents for tribo-charging, flow aids for curing/fixing, cross-linkers to build up multiple chains, and catalysts to change the degree of cross-linking by initiating polymerization. Pigments can also be added to create a desired decorative effect. It is also contemplated to provide a powder in the form of a clear coat.

According to the invention the components that make up the powder particles are ground/pulverized to make a powder with a particle size ranging from 5 microns to 50 microns, not necessarily the same as the initial particle size. The invention is particularly useful with small powder particles having a diameter of less than 20 microns and, preferably, less than 12 microns, thereby resulting in coating layers that have fewer, or substantially no pinholes, after curing.

U.S. Pat. No. 4,546,060, disclosed for the use in the field of electrography for the development of electrostatic images, discloses toner in the form of a powdered resin and processes for manufacturing such toner. Other suitable examples of toner/powder compositions are disclosed in U.S. Pat. Nos. 4,041,901, 5,065,183, and 6,342,273.

Still further, another exemplary disclosure of powder particles, their composition and manufacture, which can be used according to the invention, is provided in *Complete Guide to Powder Coatings* (Issue 1-November 1999) of Akzo Nobel.

Developers were exercised by vigorously shaking the developer to cause triboelectric charging by placing a 4-7 g portion of the developer into a 4 dram glass screw cap vial, capping the vial and shaking the vial on a "wrist-action" robot shaker operated at about 2 Hertz (Hz) and an overall amplitude of about 11 centimeters (cm) for 2 minutes. Another exercise technique was a period of 2 minutes and/or 10 minutes on top of a rotating-core magnetic brush. The vial containing the developer is constrained to the brush while the magnetic core is rotated at 2000 rpm. Thus, the developer is exercised as if it were directly on a magnetic brush, but without any loss of developer, because it is contained within the vial.

The toner Q/m ratio is measured in a MECCA device comprised of two spaced-apart, parallel, electrode plates to which both a DC electric field and an oscillating magnetic field is applied to the developer samples, thereby causing a separation of the two components of the mixture, i.e., hard ferrite carrier and powder paint particles. Typically, a 0.100 g sample of a developer mixture is placed on the bottom metal plate. The sample is then subjected for thirty (30) seconds to a 60 Hz magnetic field and potential of 2500 V across the plates, which causes developer agitation. The powder paint particles are released from the carrier particles under the combined influence of the magnetic and electric fields and are attracted to and thereby deposit on the upper electrode plate, while the magnetic carrier particles are held on the lower plate. An electrometer measures the accumulated charge of the powder on the upper plate. The powder paint Q/m ratio in terms of microcoulombs per gram (μC/g) is calculated by dividing the accumulated charge by the mass of the deposited powder taken from the upper plate.

The performance of the powder paint developers is determined using an electrographic breadboard device as described in U.S. Pat. No. 4,473,029, the teaching of which have been previously incorporated herein in their entirety. The device has two electrostatic probes, one before a magnetic brush development station and one after the station to measure the voltage on the substrate before and after coating. The substrate (e.g., aluminum, carbon steel, stainless steel, copper) is attached (with electrical continuity) to a traveling platen. The substrate is held at ground, while the magnetic brush applicator shell is biased according the the polarity of the powder paint. For example, a negatively charged powder paint would require a negative bias on the shell to propel the particles away from the developer on the shell to the grounded support. The shell and substrate are set at a spacing of 0.020 inches, the core is rotated clockwise at 1500 rpm, and the shell is rotated at 15 rpm counter-clockwise. The substrate platen was set to travel at a speed of 3 inches per second. The nap density on the development roller was ~0.5 g/in 2. After coating, the substrate was heated in an oven to cure the thermosetting powder.

Paints, or resin-based coatings, are normally applied as liquids by roller, brush, or spray. There are advantages in using dry paint powders for coating, particularity in the elimination of solvents. Dry paints are normally applied by electrostatic spray to a grounded object. In powder spray coating, the charging of the powder is achieved by corona or friction, with minimal compositional assistance. For optimal efficiency, spray gun techniques require particle sizes in the 35-100μ mean volume diameter to optimize charging and minimize fines losses. Unfortunately, dry powder coating by electrostatic spray gun is at least or order of magnitude lower in throughput (coating speed) than liquid application on coil or flat substrates. It is to be noted that smaller particles are difficult to apply with dry gun techniques.

An alternative dry application technique is electrostatic development of a powder from a hard ferrite developer in a rotating magnetic brush applicator station. This technique, in combination with high speed curing, can exceed the coating speed of liquid paint systems, without the environmental impact and costs associated with solvent. The material requirements for the powder in this system are significantly different than those of electrostatic spray gun.

To complete with liquid paint coating for throughput, dry powder coating by rotating magnet applicator needs to deliver powder at at least 2× the maximum density laydown of an electrophotographic printer, and at "page" laydowns that are 10 to 100× higher. To perform satisfactorily in a rotating magnet powder paint applicator, the powder must flow without packing, be easily charged, and triboelectrically stable. Adequate flow is needed to move the large mass of powder through a delivery system (replenisher) into the applicator sump, and then subsequently allow sufficient mixing within the sump for charging and uniformity.

Rapid charging of the incoming powder is necessary because of the high throughput. The charging level and stability of a rotating magnetic powder paint developer over time and conditions (for example, relative humidity) are important to the rotating magnet powder coating application process for several reasons:

1) Aging stability increases the replacement interval of developer.

2) Aging stability decreases the extent and complexity of process control required to maintain coating uniformity and thickness.

3) Environmental stability reduces process control requirements and broadens the range of acceptable operating conditions.

4) Charging level determines laydown thickness and dusting losses

The desired charge stability is constrained to the relatively small powder particle size neccessitated by the rotating magnet process to yield uniform coatings.

Ideally, a rotating powder paint developer should maintain a constant, and low tribocharge (or either polarity) to maximize laydown capacity and uniformity. To achieve this performance, a combination of materials is required. Charge agents are required to adjust charge level and/or stability. Surface treatment is usually employed to manage flow and delivery of the powder paint to and in the applicator mixing sump. Our results show that the level of surface treatment also interacts with the charge agent and powder particle size to determine the charge level and stability in these rotaing magnet powder paints. Toner or powder for use in the invention is, broadly, electrostatically chargeable powder for electrostatic coating systems, monocomponent development systems, or two-component development systems.

Toner or powder particles are polymeric or resin-based. Although thermoplastic resins are useable, thermosetting powders are more preferred. In two-component development, the toner/powder is mixed with magnetic carrier particles to form the developer, as explained above.

The powder/toner particles are created by blending various components, which can include binders, resins, pigments, fillers, and additives, for example, and processing the components by heating and milling, for example, whereupon a homogeneous mass is dispensed by an extruder. The mass is then cooled, crushed into small chips or lumps, and then ground into a powder.

The aforementioned additives incorporated within the powder particles can includes one or more of charge agents for tribo-charging, flow aids for curing/fixing, cross-linkers to build up multiple chains, and catalysts to change the degree of cross-linking by initiating polymerization. Pigments can also be added to create a desired decorative effect. It is also contemplated to provide a powder in the form of a clear coat.

Use of commercial electrostatic powder paints in an rotating magnet powder paint applicator results in nonuniform and thick coatings, and considerable waste. The large particles (>100μ volume mean) associated with the electrostatic powders are low charging and so easily dust out of the applicator, or, due to their high mass, are ejected from the agitation of the rotating magnetic brush. If the brush speed is decreased to reduce dusting, coating efficiency is also diminished to an undesirable level. The large particle sizes of electrostatic spray powders also dictate the minimum thickness for complete substrate coverage; the minimum is roughly the radius of a representative particle.

Smaller particle sizes (<50μ) are preferred in a rotating magnet powder applicator to generate uniform coatings at high substrate speed characteristic of powder painting. Compared to printing operations, the amount of marking material (i.e, plastic or ink) used for powder painting can be well over an order of magnitude higher. Offset inking is usually <1μ in thickness, electrophotographic images are <10μ layer thickness, while powder painting commonly requires 50-100μ layer thicknesses for substrate protection. The thicker layers follow from the large particulates used in electrostatic spray coating; higher laydowns are neccessary to ensure that a minimum coverage is realized.

Commercial powder paints can be utilized in rotating brush applicator systems by reprocessing the powder through low temperature extrusion and recompounding. And pulverization with addenda such as charge agents and surface treatment.

According to the invention the components that make up the powder particles are ground/pulverized to make a powder with a particle size ranging from 5 microns to 50 microns, not necessarily the same as the initial particle size. The invention is particularly useful with small powder particles having a diameter of less than 20 microns and, preferably, less than 12 microns, thereby resulting in coating layers that have fewer, or substantially no pinholes, after curing.

As described in U.S. Pat. No. 6,228,549, conventionally, carrier particles made of soft magnetic materials have been employed to carry and deliver the toner particles to the electrostatic image. U.S. Pat. Nos. 4,546,060, 4,473,029 and 5,376,492, the teaching of which are incorporated herein by reference in their entirety, teach the use of hard magnetic materials as carrier particles and also the apparatus for the development of electrostatic images utilizing such hard magnetic carrier particle with a rotating magnet core applicator. These patents require that the carrier particles comprise a hard magnetic material exhibiting a coercivity of at least 300 Oesteds when magnetically saturated and an induced moment of at least 20 emu/g when in a field of 1000 Oesteds. The terms "hard" and "soft" when referring to magnetic materials have the generally accepted meaning as indicated on page 18 of "Introduction To Magnetic Materials" by B. D. Cullity published by Addison-Wesley Publishing Company 1972. These hard magnetic carrier particles represent a great advance over the use of soft magnetic carrier materials in the speed of development is remarkably increased with good image development.

Alternatively, the carrier particles can be used without coating, or with an appropriate polymeric coating.

Various resin materials can be employed as coating on the hard magnetic carrier particles. Examples include those described in U.S. Pat. Nos. 3,795,617; 3,795,618 and 4,076,857, the teaching of which are incorporated herein by reference in their entirety. The choice of resin will depend upon its triboelectric relationship with the interned toner/powder. For use with toners which are desired to be positively charged, preferred resins for the carrier coating include fluorocarbon polymers such as poly(tetrafluoroethylene), poly(vinylidene fluoride) and ploy(vinylidene fluoride-co-tetrafluoroethylene). For use with toners which are desired to be negatively charged, preferred resins for the carrier include silicone resins, as well as mixtures of resins, such as a mixture of poly (vinylidene fluoride) and polymethylmethacryalte. Various polymers suitable for such coatings are also described in U.S. Pat. No. 5,512,403, the teaching of which are incorporated herein by reference in their entirety.

The carrier particles may also be semiconductive or conductive as described in U.S. Pat. Nos. 4,764,445; 4,855,206; 6,228,549 and 6,232,026, the teaching of which are incorporated herein by reference in their entirety.

The particle size of the carriers is less than 100μ volume average diameter, preferably from about 3 to 65 and, more preferably, about 5 to 20μ. The carrier particles are then magnetized by subjecting them to an applied magnetic field of sufficient strength to yield magnetic hysteresis behavior.

Exemplary Implementations

A white epoxy polyester powder paint (experimental product from vendor) was recompounded without charge agent for 15 minutes at 100 rpm on a Brabender Plasti-Coater at 90° C. The resulting melt was coarse ground on a Wiley Number 4 mill and pulverized on a Trost TX mill at 70 psi, 1 g/min feed rate. The particle size of the powder were measured on a Aerosizer LD (API, Amherst, Mass.) to be 10.59μ volume median. The powder was surface treated with fumed silica (R972, Degussa) at 0, 0.2, 0.5 and 1.25 wt % in a Waring blender. A commercially available SrFe12O19 hard ferrite core (PowderTech International Corporation, Valparaiso, Ind.) was mixed with 0.3 pph of PMMA (polymethylmethacrylate, Espirit 1201) and cured at 230° C. to yield a coated carrier. A 10% powder concentration (PC) was prepared from 100 milligrams of each powder combined with 0.9 g of the strontium ferrite carrier.

The recompounding of the powder paint requires that the process temperature be high enough to mix the charge agent without changing the rheology of the powder paint. For example, at high process temperature, crosslinking drives the viscosity upwards to met the requirements of the finished coating. This complicates grinding of the etruded melt, and more importantly, restricts flow of the powder during curing.

Figure 9:
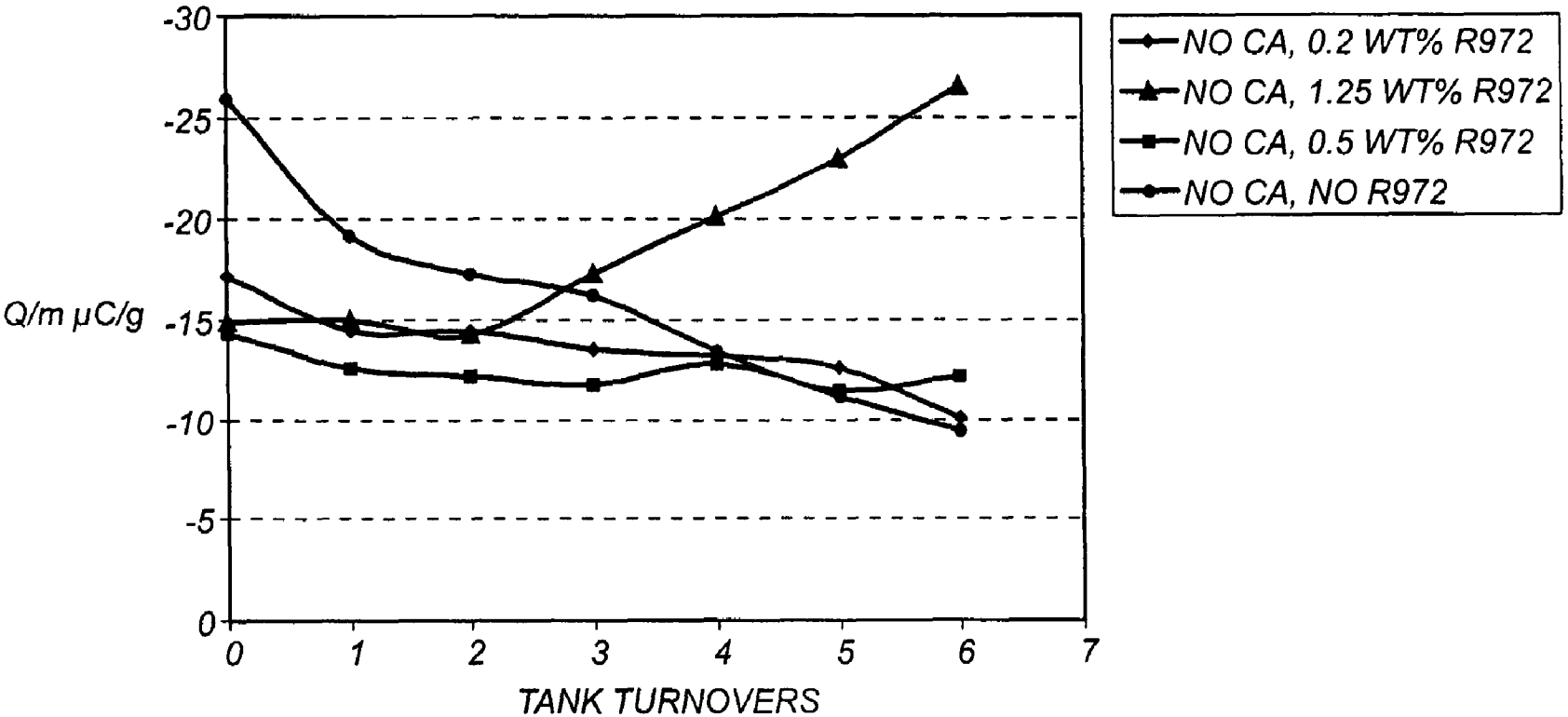
FIG. 9 is a graph of charge to mass results.

The developer was exercised on a rotating core bottle brush exercise appartus for 10 minutes at 1000 rpm. Two MECCA measurements at 0.25 g were made to determine the charge-to-mass of the powder. The stripped carrier from the charge measurements was returned to the remaining developer along with fresh powder to bring the PC back to 10%. The procedure was repeated for 6 cycles, with each cycle coresponding to ½ of a powder "turnover". The offline test mimics the aging and replenishment within a SPD applicator. The charge to mass results are shown in FIG. 9.

Figure 10:
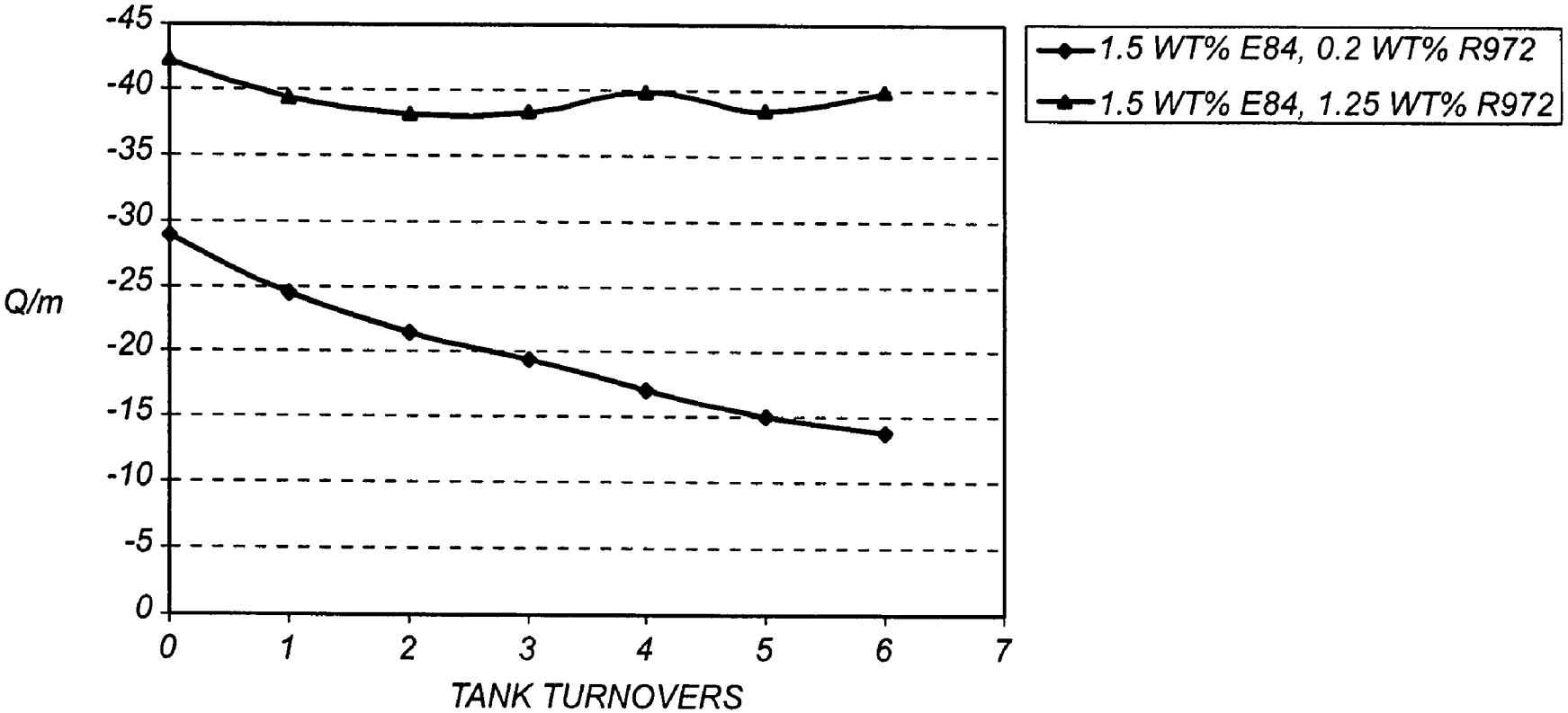
FIG. 10 is a graph showing charge-to-mass trends for an offline aging test.

The starting charge for the silica treated powders are similar, while the untreated sample is significantly higher. The intermediate levels of surface treatment (0.2 and 0.5 wt %) shown acceptable stability through the course of the test, while the highest surface treatment (1.25 wt %) exhibits a rapid and undesired charge increase after the second cycle. In comparison, a sample was prepared as in the above example with 1.5 wt % Bontron E-84 charge agent (Orient Corp of America, N.J.). The particle size was 5.94μ volume median. Powders were treated at 0.2 and 1.25 wt %. The charge-to-mass trends for the offline aging test are shown in FIG. 10.

The effect of the charge agent is seen in the starting charge, while the level of surface treatment required for stability is at least 1.25 wt %. The higher surface area of the E-84 powder influences the amount of surface treatment required for charge stability.

Figure 11:
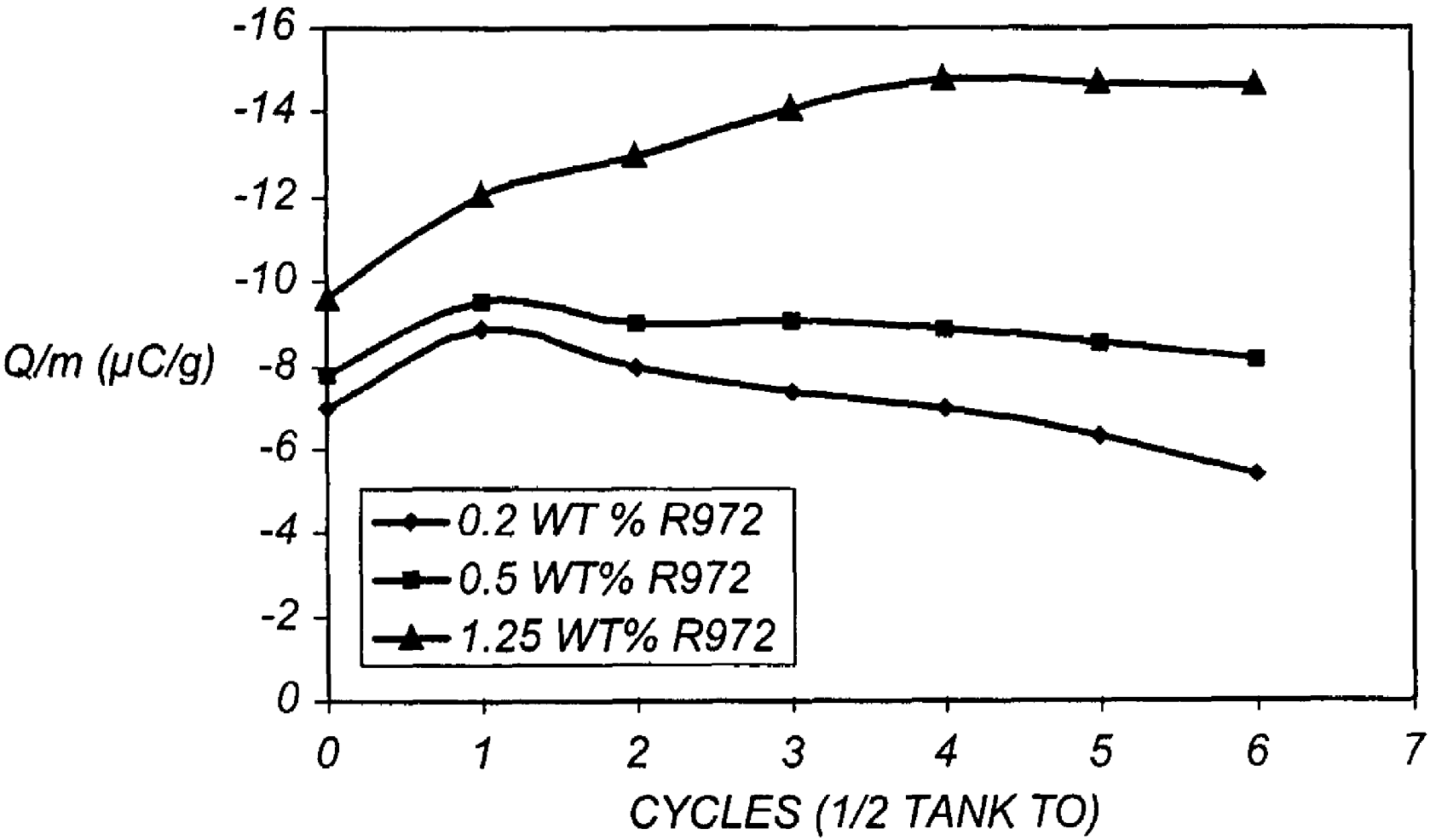
FIG. 11 is a graph showing charge stability effects with differing charge agents.

Similar effects are seen in FIG. 11 with different charge agents, for example, the same epoxy polester powder paint recompounded with benzyldimethyloctadecyl ammonium 3-nitrobenzene-sulfonic acid (Eastman Kodak) charge agent.

Figure 12:
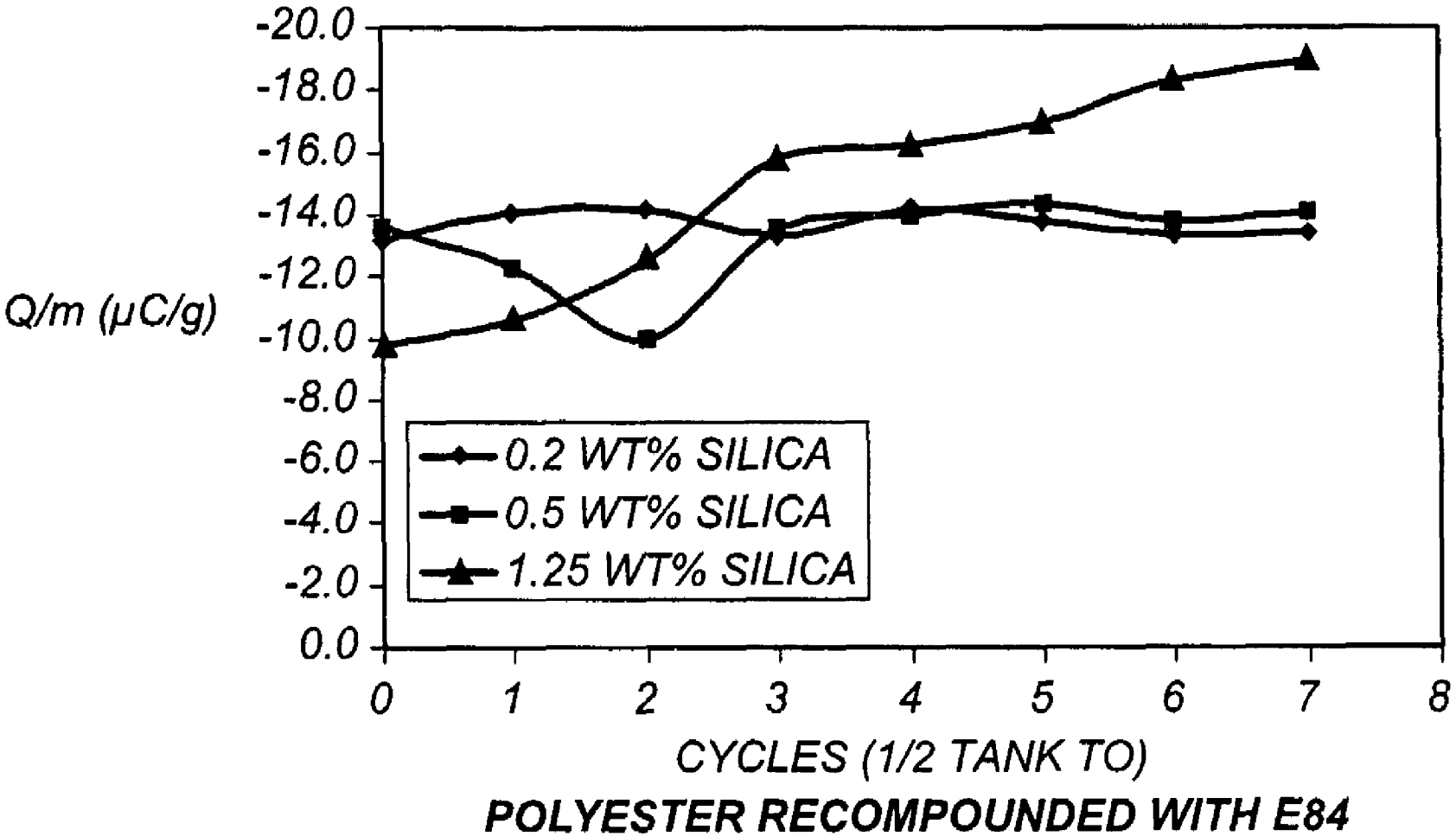
FIG. 12 is a graph showing charge-to-mass trends for an offline aging test.

A low gloss gray commercial powder paint (Corvel Ansi 61 U1575-1 7056 HY) from Rohm and Haas Powder Coatings was reprocessed to prepare a powder for rotating magnet brush application. The urethane polyester has a particle size of 36.3μ volume median as received. The powder was recompounded with 1.5 pph of E84 charge agent in a twin screw extruder at a temperature of 140° F. and die temperature of 160° F. at 10 kg/hr and a screw rpm of 490. After granulation, the materials was jet milled and classified to produce a powder with volume median of 12.9μ by Coulter Counter. 10 g quantities of the powder were surface treated with silica (R972, Degussa) at 0.2, 0.5 and 1.25 wt % in a Waring blender and evaluated in the offline aging test described above. The results are shown in FIG. 12.

In addition, developers of these powders, and the non-surface-treated powder were visually checked on a rotating magnet applicator. The 0.2 and 0.5 wt % treatments showed no dusting, while the 1.25 wt % produced a noticeable quantity of dust.

The 0.2 wt % surface treatment was scaled to 2.5 kg. This powder prepared as a 10% PC developer with the coated strontium ferrite carrier was evaluated on the breadboard test device described above. Coatings were obtained at different bias levels; all cured coatings were uniform and continuous. The bias dependence of the coating coverage is shown in the table below:

| coverage ($g/m^2$) | bias (V) |
|---|---|
| 13.5 | −150 |
| 19.9 | −200 |
| 26.3 | −300 |
| 31.7 | −500 |

Powder coating has requirements for thickness, uniformity, and process speed. Electrophotography has additional requirements for uniform development of large black areas of an image and uniform width for lines independent of the direction of the line with respect to the process direction. The maximum number of toner particles in the background areas of the image, or in the white areas of the image, must also be tightly controlled. Relaxing the requirements for variable images allows magnetic brush development, and particularly rotating magnetic brush development, to operate at much higher speeds for powder coating systems than for imaging systems, and to produce much larger mass area densities if required.

Although setpoints that are used in image development apparatus could be utilized for the powder coating apparatus of the invention, it has been found that different setpoints provide superior results for powder coating. In particular, larger spacings are used from the toning shell to the receiver. Either core rotational speed, shell rotational speed, or both core and shell speed are preferably faster than the setpoints that are used in image development apparatus. For thin, uniform coatings, a shell rotational speed corresponding to a speed of the shell surface that is less than 10% of the speed of the receiver provides improved results. A stationary or very slowly moving shell can also be used. To allow more material to be available for deposition, greater skive spacings are used for powder coating than for imaging. For large skive spacings, and with a stationary or slowly-moving shell, the flow of developer onto the shell is controlled primarily by the field of the rotating magnetic core. Toner concentrations for powder coating can be greater than those used in electrophotography. In imaging applications, high toner concentrations produce undesirable background toning. This is not a concern in powder coating.

The process and hardware setpoints that can be used for powder coating allow a much wider range of mass area density to be obtained for powder coating applications than is typically needed for images. For example, in imaging systems, the developer electrode is spaced at a small distance from the image so that small lines or halftone dots are developed and electrostatic fringe fields at the edge of large, solid areas are not exaggerated. This can be done by making the applicator roller surface very close to the surface of the image. However, this introduces an engineering tradeoff. The small space between the roller and the substrate limits the amount of powder that is available for deposition. This requirement is relaxed for powder coating, larger spacings from the applicator roller to the receiver can be used, enabling larger skive spacings to be used, providing much more material available for deposition.

Receiver spacings greater than 14 mils and preferably greater than 28 mils can be used. Receiver spacings are greater than 30% and, preferably, greater than 50% of the nap height of the electromagnetic brushes. In addition, preferably, the skive spacings are at least 50% of the nap height of the electromagnetic brushes.

Still further, the toner/powder concentrations are greater than 10% by weight and, preferably, greater than 15% by weight for material with density approximately equal to 1 g/cm$^3$. For heavier or lighter materials, powder concentrations measured by weight can be adjusted according to density. For example, compared to a material with a specific gravity of 1 at a concentration of 10% by weight, a material with specific gravity 1.2 has an equivalent concentration of 1.2 ×10% =12% by weight.

The foregoing setpoints would be less than suitable for use in image development, since they would result in differences between leading edges and trailing edges, visible field effects in the image areas, and toner (or powder) present in the background areas of the image.

In addition, the bias voltages for powder coating are also not constrained to the range allowed by photoconductors, and can exceed 1000 volts DC. Voltages up to the onset of significant corona can be used, as high as 7,000 to 10,000 V. If the toning shell is coated with an insulator, higher voltages can be used, such that the breakdown voltage of the insulative coating is not exceeded. A suitable insulator is Red Insulating Varnish S00601, produced by Sherwin-Williams Company, Diversified Brands, Inc. Sprayon Products Group, Solon, Ohio, USA. This material has a dielectric strength of 2100 vpm or volts per mil. For a toning shell coated with this material, the maximum bias voltage for deposition is determined by the voltage drop across the coating, which is a portion of the total voltage drop from the toning shell to the receiver. DC voltages or DC voltages with superimposed AC components can be used. Other insulative coatings with high arc resistance may be used.

The Equilibrium Theory is widely accepted as the mechanism of particle deposition with insulative magnetic brush development. (Schein 1996). Polymeric toner particles are bound to the carrier particles by electrostatic forces and also by surface forces. In the Equilibrium Theory, toner is freed from the carrier and deposited on the substrate only in three-body contact events in which, for electrophotography, the toner simultaneously contacts both the carrier and the substrate. During this contact event, surface forces between the polymeric toner particle and the substrate counteract surface forces holding the toner particle to the carrier, and the particle is deposited on the substrate by electrostatic forces.

Rotating magnetic brush development is not described by the Equilibrium Theory. Deposition rates for rotating magnetic brush development typically exceed predictions of the Equilibrium Theory, which does not take into account the significant effect of brush agitation produced by the rotating magnetic core.

In the Equilibrium Theory, mass per unit area for particle deposition on a substrate is given by, $$\frac{M}{A} = \frac{\varepsilon_0 V}{Q/M}\frac{\nu}{\Lambda} \qquad \text{(Schein, 1996 Eq. 6.56)}$$

where M/A is mass per unit area in g/cm$^2$, Q/M is the charge-to-mass ratio for the polymeric particle in units of C/g, $\epsilon_0$ is the permittivity of free space in F/cm, V is the voltage between the substrate and the toning shell, ν is the ratio of the velocity of the development roller to the velocity of the substrate, and Λ is the dielectric distance from the applicator roller electrode to the carrier charge in cm. The parameter Λ is usually fitted to experimental data.

Experimental powder coatings were made directly onto an aluminum substrate on a web press using commercially available materials and hardware from commercially available equipment made by Eastman Kodak Company.

Gray paint was used that is a modified version of Morton 20-7056 HY2 polyester powder paint (Rohm and Haas, Morton Powder Coatings, Reading, Pa.). The commercial material was recompounded on an extruder at a temperature of 140-160 degrees F. with 1.5 pph of a charge agent, Bontron E-84, a zinc complex of ditertbutylsalicylic acid (Orient Chemicals of Japan). The coarse extrudate was pulverized into a particulate form, and then classified to yield a volume median of 12.9 microns as determined by a Coulter Counter device. The pulverized powder was surface treated with 0.2 wt % of R972 silica (Degussa of Germany).

A developer was prepared from the above powder at a paint concentration of 15 weight percent with a strontium ferrite hard magnet core powder (Powdertech Corporation, Valparaiso, In) coated with 0.3 pph of polymethylmethacrylate (Soken 1201, Japan). The carrier was coated with this polymer by admixing the polymer with the carrier, followed by heating the admixture in an oven to a point sufficient to fuse the polymer to the carrier. The carrier has a volume mean of 21 microns by Coulter Counter. The developer was prepared by agitating on a paint shaker for 1 minute. A developer was also prepared from the non-surface-treated powder.

A black commercial styrene butylacrylate toner (D1; Heidelberg Digital L.L.C., Rochester, N.Y.) was also used. The extruded blend is pulverized to powder form and classified to yield a volume mean of 11.5 microns by Coulter Counter. A developer was made using the procedure above.

Figure 2A:
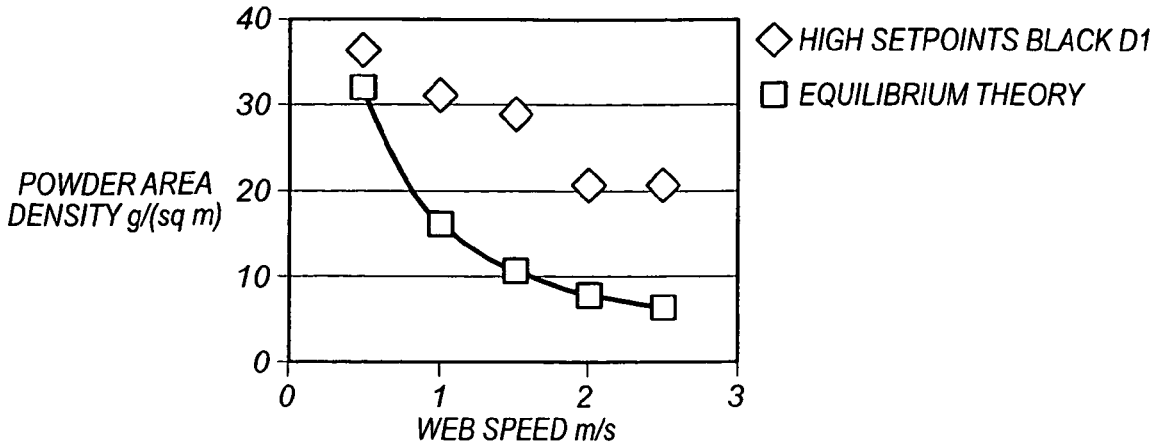
FIG. 2*a* is a plot of data showing mass per unit area deposited on a substrate as a function of substrate speed.
Figure 2B:
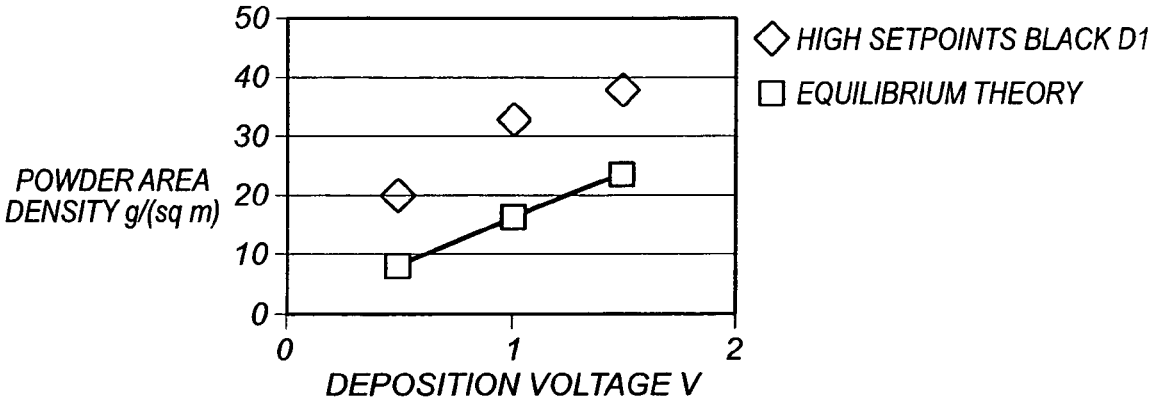
FIG. 2*b* is a plot of data showing mass per unit area deposited on a substrate as a function of deposition voltage.
Figure 2C:
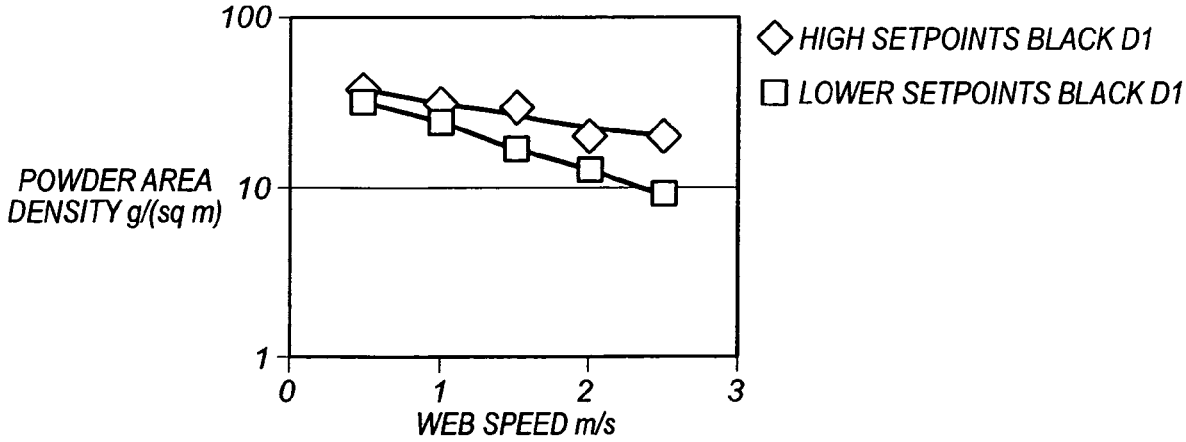
FIG. 2*c* is a log plot of data showing mass per unit area deposited on a substrate for two different magnetic brush setpoints.

Results for D1 toner are shown in FIG. 2*a*, FIG. 2*b*, FIG. 2*c*, and FIG. 2*d*. All measurements for FIG. 2*a* and FIG. 2*b* were made with the same core speed and shell speed, which were increased from typical electrophotographic setpoints. The mass area density data for FIG. 2*a* and FIG. 2*b* are shown in Table 1. Core speed of 2765 RPM was used, corresponding to 645 pole flips per second for a 14 pole magnetic core. Shell speeds of 423 RPM were used, corresponding for a 2 inch diameter shell to a surface speed of 1.125 m/sec. The spacing from the shell surface to the receiver was 30 mils, and the skive was set to 45 mils. Nap height for the material is approximately 48 mils. The data for FIG. 2*a* was taken at 1 kV bias. The data for FIG. 2*b* was taken at 1 m/s receiver speed. FIG. 2*c* includes additional measurements of area densities obtained with core speeds of 1141 RPM, corresponding to 266 pole flips per second, and shell speeds of 129.1 RPM, corresponding to a surface speed 0.34 m/s, with a skive setting of 28 mils. All other magnetic brush setpoints for this data were the same. The mass area density measurements for the low core speed, low shell speed, and low skive spacing setpoints used in the data of FIG. 2*c* are shown in Table 2. For comparison with the Equilibrium Theory, Λ was determined by measuring mass area density with the magnetic core fixed at receiver speeds of 0.5 m/s, toner charge to mass ratio of 14.26 μC/g, and bias voltage of 1 kV. For the low shell speed, low skive setting, mass area density was 10.38 g/m$^2$ and Λ was found to be approximately 41 microns, For the high shell speed, high skive setting, mass area density was 32.08 g/m$^2$ and Λ was found to be approximately 44 microns.

TABLE 1

Data for D1 toner at high shell speed, high core speed, and high skive spacing.

| Toning Bias kVdc | Web Speed m/s | Toner Laydown g/m^2 |
|---|---|---|
| 0.5 | 1 | 19.84 |
| 1 | 1 | 33.01 |
| 1.5 | 1 | 38.13 |

TABLE 1-continued

Data for D1 toner at high shell speed, high core speed, and high skive spacing.

| Toning Bias kVdc | Web Speed m/s | Toner Laydown g/m^2 |
|---|---|---|
| 1 | 0.5 | 36.27 |
| 1 | 1 | 31 |
| 1 | 1.5 | 28.98 |
| 1 | 2 | 20.61 |
| 1 | 2.5 | 20.61 |

TABLE 2

Data for D1 toner at low shell speed, low core speed, and low skive spacing.

| Toning Bias kVdc | Web Speed m/s | Toner Laydown g/m^2 |
|---|---|---|
| 1 | 0.5 | 31.31 |
| 1 | 1 | 25.26 |
| 1 | 1.5 | 16.46 |
| 1 | 2 | 13.95 |
| 1 | 2.5 | 9.3 |

Powder area density for rotating magnetic brush is much greater than predicted by the Equilibrium Theory, as shown in FIG. 2*a* and FIG. 2*b*. For fixed shell speed, core speed, and bias voltage, the mass area density decreases approximately exponentially with substrate speed. This is shown in FIG. 2*c*, in which the data from Table 1 used in FIG. 2*a* is replotted with area densities from Table 2, which were obtained with the applicator set to the slower core speed, slower shell speed, and lower skive spacing.

Further analysis based on the transit time through the magnetic brush shows that deposition depends on the amount of available powder and has similar time dependence to a capacitor during charging. For a nip having a width L, transit time T for a substrate with velocity v is given by T =L/v. Nip width L for the present development system is approximately 0.375 inches (0.953 cm) If the maximum mass area density for a given voltage is $D_{M0}$ mass area density $D_M$ is given by $$D_M = D_{M0}\left(1 - e^{-\frac{k}{v}}\right)$$

Figure 2D:
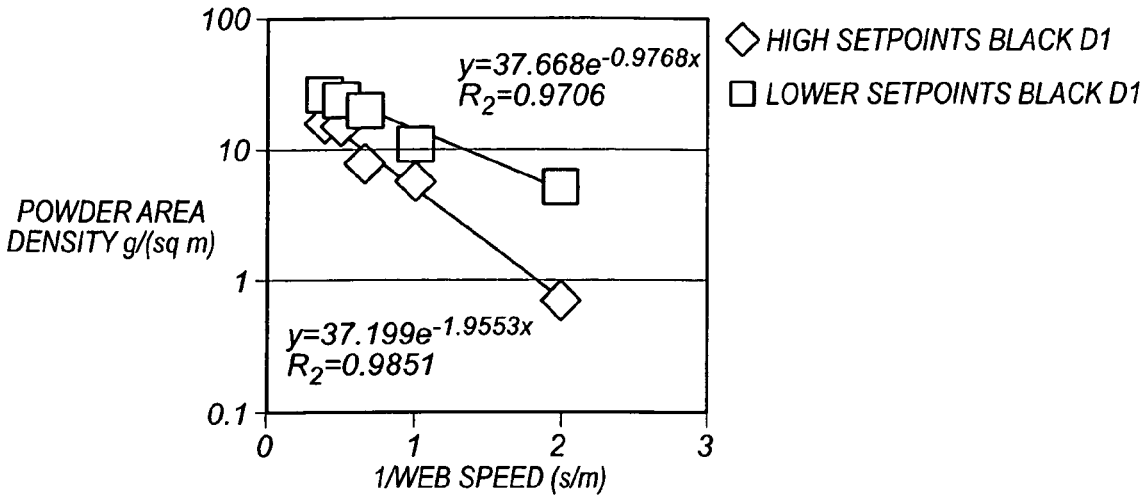
FIG. 2*d* is a log plot of data showing mass per unit area deposited on a substrate.

The mass area density data shown in FIG. 2*c* minus $D_{M0}$, where $D_{M0}$=37 g/m$^2$ is replotted vs. 1/v in FIG. 2*d*. The constants for the exponential are functions of core speed, shell speed, charge to mass ratio, and powder concentration. For powder coating, exponential constants k of magnitude greater than 1 m/s are preferred, where substrate velocity is measured in m/s. The exponential constant should be greater than 1 m/s in magnitude, and preferably greater than 1.5 m/s in magnitude. Increasing nip width will increase the magnitude of the exponential constant and increase the mass area density, with all other conditions remaining the same. Mass area density at a given coating speed can be increased within limits by higher powder concentrations in the magnetic brush, higher core speeds, and higher bias voltages. With D1 toner, mass area density of 40 g/m2 was obtained at 2 m/s web speed with 1.5 kV DC bias and core speeds of 3555 RPM.

The developer prepared from the non-surface-treated gray powder paint was characterized by large scale mottle, frequent banding and replenishment artifacts such as bridging and packing. Upon standing the developer in the station was sluggish and mixed poorly. The surface-treated powder developer was showed improved flow and mixing and minimal replenishment artfacts.

Figure 2E:
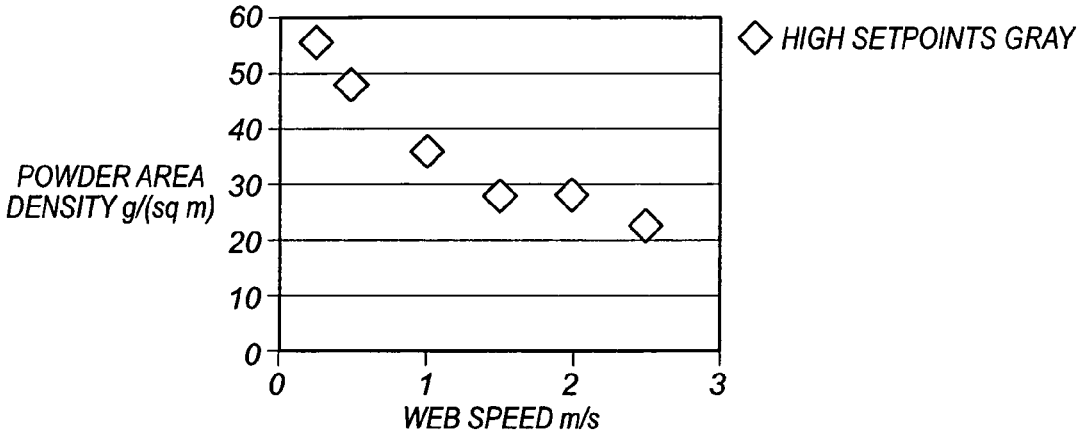
FIG. 2*e* is a log plot of data showing mass per unit area deposited on a substrate for a prepared powder paint material.
Figure 2F:
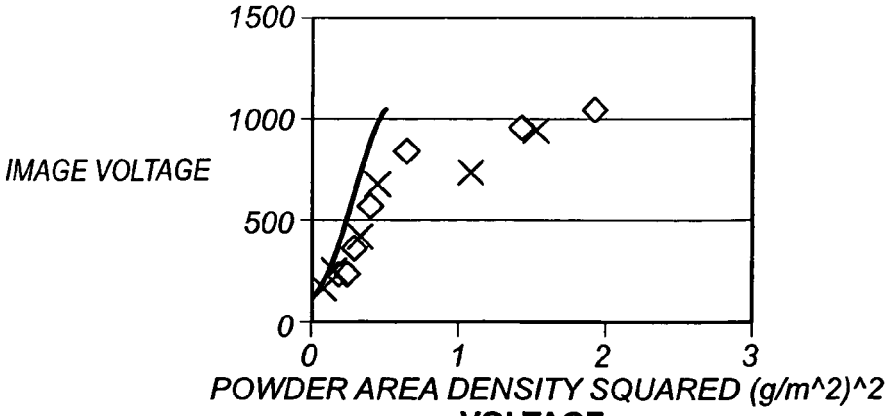
FIG. 2*f* is a plot of surface voltage measurements for a prepared powder paint material as a function of mass per unit area deposited on a substrate.

Mass area densities obtained with the gray powder paint are listed in Table 3 and shown in FIG. 2*e*. These values are similar to those obtained with black D1 toner. This data was obtained with the applicator roller set in the same configuration as for the data in Table 1, but with bias voltage of 1.5 kV and core speed of 3555 RPM, corresponding to 830 pole flips per second. The powder was at a concentration in the developer of 15 wt. % and had a charge of 22 μC/g. At the beginning of the coating, the developer gave a MECCA charge of 22.0 μC/g, and through the trial using 5 kg of powder maintained charge in the 22-30 μC/g range.

TABLE 3

Mass area density for gray powder paint.

| Web Speed m/s | Mass Area Density g/m^2 |
|---|---|
| 0.25 | 55.18 |
| 0.5 | 47.74 |
| 1 | 35.34 |
| 1.5 | 27.9 |
| 2 | 27.74 |
| 2.5 | 22.32 |

Voltages for the deposited layers of the gray powder paint are shown in Table 4 and in FIG. 2*f* are plotted vs. the square of mass area density. Absolute value of voltage is plotted. The straight line in FIG. 2*f* is mass area density squared. Particle charge was −29.63 μC/g for the first group of data and −25.13 μC/g for the second group of data. This data shows that voltage for thin coatings is proportional to the amount of material per unit area squared as well as proportional to charge per particle or charge per mass. The amount of material per unit area can be represented by the height of the deposited layer, optical absorption, mass per unit area, or other similar parameters. Measurements of voltage for a given amount of material per unit area can be used to control particle charge by replenishing paint particles into the developer reservoir or by other means.

TABLE 4

Surface voltage for deposited layers of gray powder paint.

| Mass Area Density g/m^2 | Surface Voltage |
|---|---|
| 55.03 | −930 |
| 46.96 | −720 |
| 30.69 | −680 |
| 26.66 | −420 |
| 18.03 | −250 |
| 13.64 | −170 |
| 62.16 | −1040 |
| 54.09 | −940 |
| 35.96 | −820 |
| 28.21 | −550 |
| 24.96 | −360 |
| 19.06 | −230 |
| 22.63 | −230 |

After curing, the cross track uniformity over the 6 inch wide coating was <10% variability. The cured coatings were uniform, and free of pinholes. Curing coatings at the recommended time and temperature (10 minutes at 205° C.) gave a crosslinked layer that exhibited minimal gloss change after multiple acetone tissue wipes, indicating that the curing characteristics of the reprocessed powder had not significantly changed.

Modifications may be made. For example, to increase mass area densities or to reduce banding, larger diameter cores with more magnets and larger diameter toning shells can be used to increase the nip width or the transition time of the receiver through the nip. Other materials can be used. Similar deposition rates have been measured for stainless steel, aluminum, and ferromagnetic, low carbon steel substrates. Slower shell speeds can be used to make thinner, uniform coatings.

Figure 3:
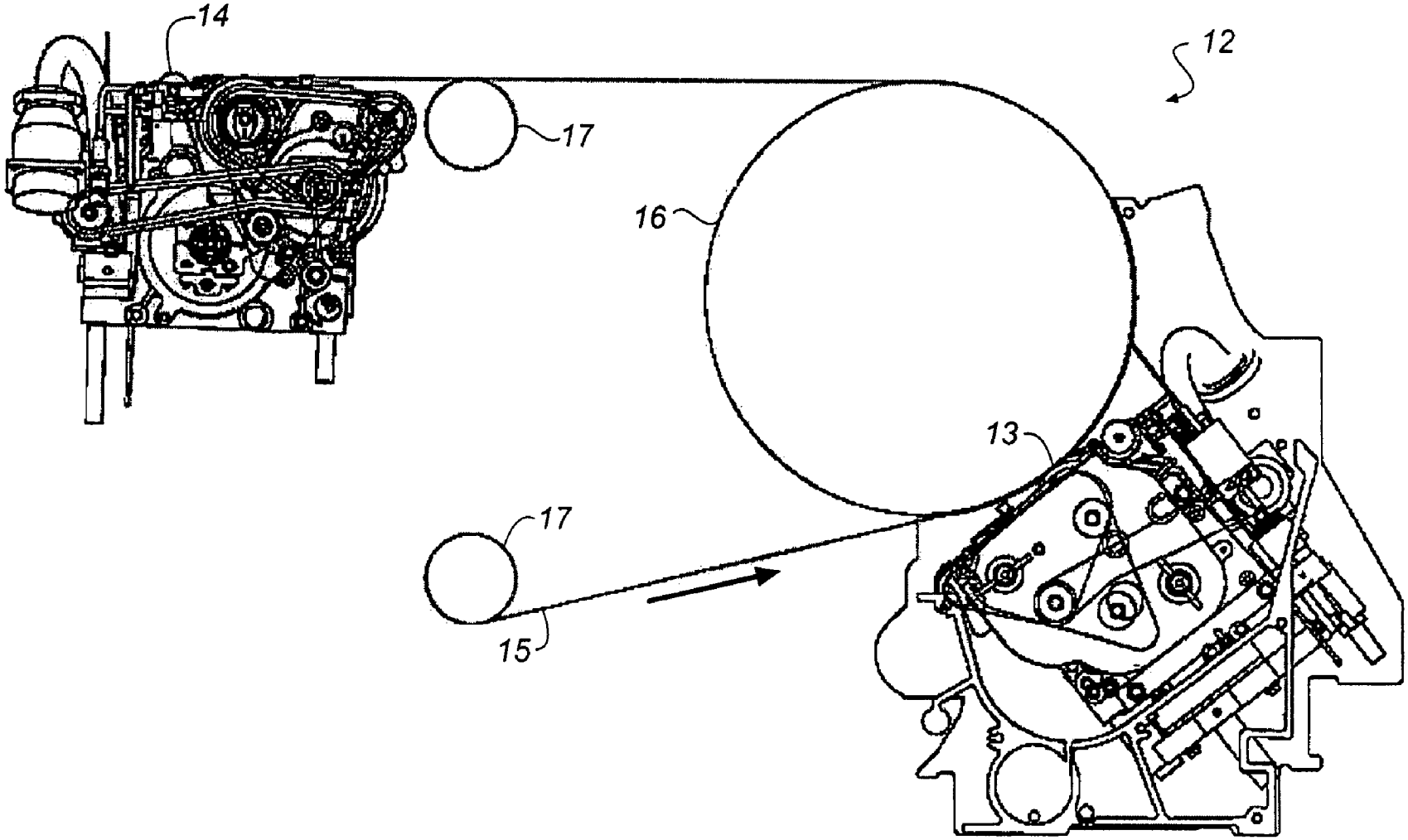
FIG. 3 is a schematic side view of a first exemplary implementation of a powder coating apparatus according to the invention.
Figure 4:
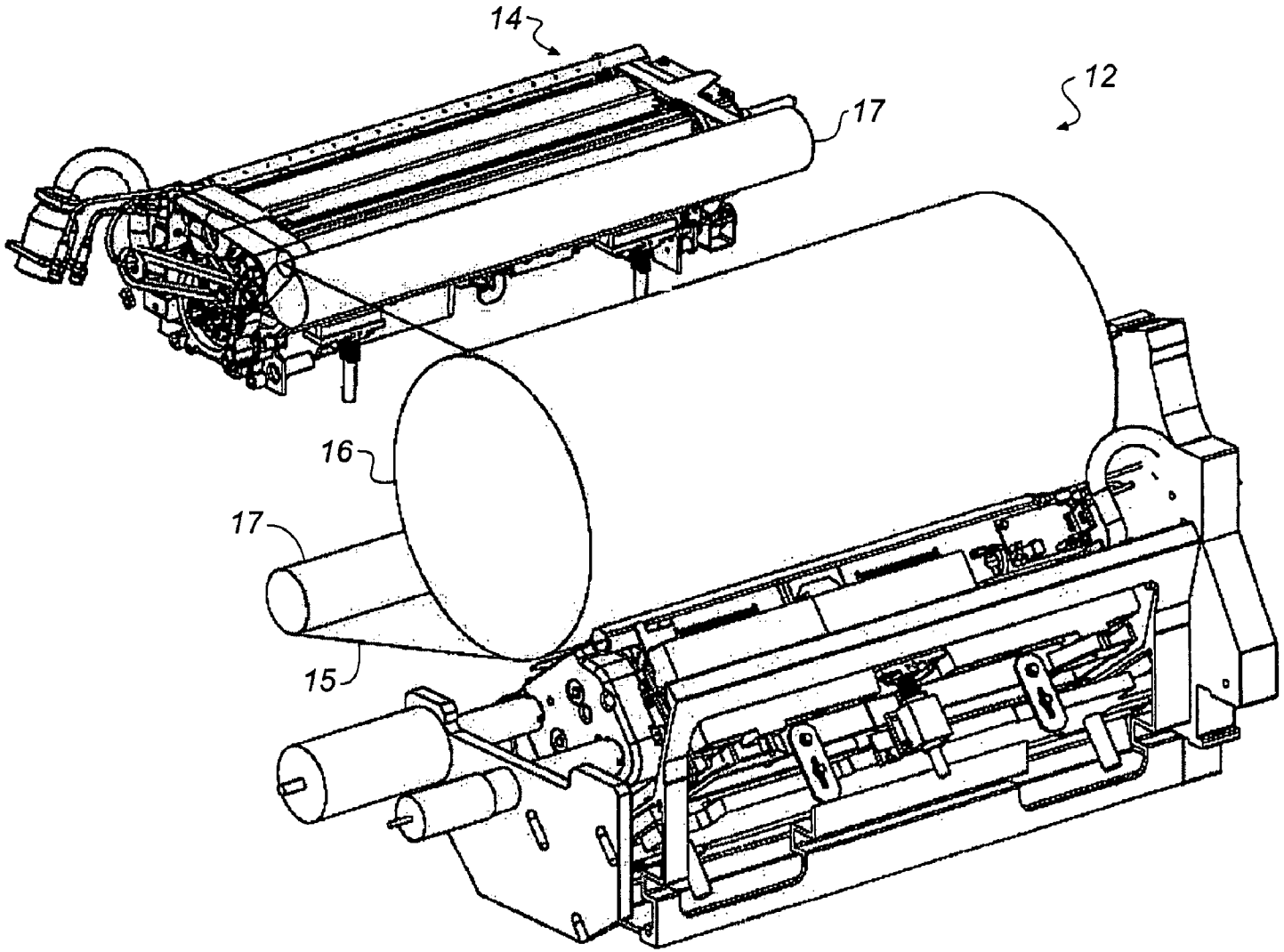
FIG. 4 is a perspective view of the apparatus shown in FIG. 3.

FIG. 3 is a schematic side view of a first exemplary implementation of a powder coating apparatus 12 according to the invention. FIG. 4 shows the apparatus in perspective. For convenience, the remainder of the web has been omitted, as have been the downstream scavengers, process control sensors, and powder coat curing station.

The apparatus 12 includes two development, or electromagnetic brush, stations 13 and 14, such as that which has been described above in connection with FIGS. 1 and 2, which sequentially coat the substrate. More particularly, the stations 13, 14 apply coatings to the respective opposite sides of the web 15. The web is supported by support rollers 17. As the web travels in the direction shown by the arrow, it is first coated on the outer side at station 13 and, after being redirected around roller 16, the inner side of the web is coated at station 14. Although the size of the apparatus according to the invention can vary depending upon the application for which it is intended, as an example, the roller 16 can have a diameter of about 12 inches. In an embodiment, the toning stations are disengaged from the receiver and the spacing between the toning stations and the receiver is increased when it is not desired to coat sections of the web during setup or passage of splices and damaged lengths of the web.

The two coatings applied at stations 13 and 14 are independent. Although they could utilize the same powder coating composition, they could also utilize different compositions, including different colors. The thicknesses of the two coatings could be the same, or depending upon the product intended to be produced by the apparatus, the thicknesses could be different.

The geometry of the magnetic brush station 13 is similar to that shown in FIG. 1B of U.S. Pat. No. 4,460,266, in that the development roller is adjacent a cylindrical surface, although there are differences. The magnetic brush station 13 contains a rotating magnetic core, and in the preferred embodiment, the web in the invention is wrapped around a cylinder for support.

Although the web 15 in FIG. 3 is the substrate to be coated, a web or belt, or a plurality of parallel belts, could be used to support individual sheets, or even another web that are then coated at the two stations 13, 14.

In a variation of the apparatus shown in FIGS. 3 and 4, it is contemplated according to the invention that two or more electromagnetic brush stations can be positioned to coat the same side of the web/substrate. In such an embodiment, the stations could apply different color coatings that could be placed adjacent one another or overlap one another, to provide certain protective or aesthetic effects. For example, if it were desired to produce a two-layer coating on the web/substrate, a powder of a first composition, perhaps a primer, could be applied at a first station using powder paint particles of the first composition, and a layer of a second composition could be applied thereover, or registered therewith, at a subsequent station.

FIG. 5 is a schematic side view of a second exemplary implementation of a powder coating apparatus 18 according to the invention.

For extremely fast substrate speeds or for heavy laydowns on a substrate, the invention encompasses an apparatus like that shown in FIG. 5 having multiple toning stations, i.e., multiple electromagnetic brush powder deposition stations 19*a*, 19*b*, 19*c* arranged around a portion of a drum 21, on which a substrate 22, or plurality of substrates, is/are supported. Charging devices 29*a*-29*c* charge and treat the substrate. Process control of the apparatus can be effected by using, at each of the stations 19*a*, 19*b*, 19*c*, an optical densitometer or optical thickness measurement device 23*a*, 23*b*, 23*c*, an electrometer 26*a*-26*f*, or other means, as shown in FIG. 5. Although three stations are shown, additional stations are also contemplated according to the invention.

The toning station biases can be arranged to put down an equal amount of powder of the same composition at each station 19*a*, 19*b*, 19*c*. However, if multiple stations are used, the first station 19*a* that the substrate 22 passes in its rotation, shown by the arrow in FIG. 5, should deposit the majority of powder in terms of mass of powder per unit area. The subsequent stations 19*b*, 19*c*, etc. will each deposit less powder than the first station 19*a*. In other words, the first station should deposit the majority of the mass per unit area and the last station should be biased to deposit a much smaller additional amount of powder. In this way, fluctuations in mass per unit area produced by the last toning station that the receiver passes will be less than that produced by the first station, and any non-uniformity produced by the first station will be evened out.

For example, if two powder deposition stations are used with positively charged toner/powder and a conductive substrate, the first station can be biased to 750 volts with respect to the substrate bias (usually ground), and the second station can be biased to 1000 volts with respect to the substrate bias. This is preferable to biasing the toning stations at 500 volts and 1000 volts. Process control can be implemented independently for each toning station. This can be done such as by measuring thickness fluctuations within a characteristic frequency range and feeding a correction signal back to the applicator. This method can be used to correct for aperiodic thickness variations, such as slow increases or decreases in thickness, and for periodic thickness variations. Periodic variations in thickness of approximately known amplitude and frequency expected after a first toning station can also be corrected by feeding a periodically varying test voltage to the first toning station, preferably at the expected fundamental frequency and expected amplitude to compensate for expected thickness variations in the coating, and adjusting the amplitude, phase, and spectral components of the test voltage to minimize variation in the output. Alternately, a second applicator can be used to compensate for variations in the coating produced by the first applicator, using a second thickness sensor after the second applicator.

Referring to FIG. 5, variation of the coating thickness of the first toning station 19*a* can be measured by process control sensors represented by densitometer 23*a* and electrometer 27*a*, and compensated by adjusting the bias voltage of toning station 19*b* by adding a correction voltage proportional to the error and monitoring the coating after toning station 19*b* with densitometer 23*b* and electrometer 26*d*. Periodic variations in thickness of approximately known amplitude and frequency expected to occur after a first toning station 19*a* can also be corrected by feeding a periodically varying test voltage to toning station 19*b*, preferably at the expected fundamental frequency and expected amplitude to compensate for expected thickness variations in the coating, and adjusting the amplitude, phase, and spectral components of the test voltage to minimize variation in the output measured by densitometer 23*b* and electrometer 26*d*.

According to another aspect of this second exemplary powder coating implementation apparatus 18 according to the invention, each powder deposition station 19*a*-19*c*, etc. adjacent a single side of the substrate can deposit a different material, so that a layered structure is produced on the receiver. However, there will be some cross-contamination between stations. The cross-contamination can be reduced if projection coating is used for the second and subsequent layers of material, or if each layer is deposited onto an intermediate transfer member or material, and then transferred onto the substrate, as described in more detail below. Cross contamination can also be reduced if each layer is electrostatically charged to increase the charge per powder particle before deposition of subsequent layers. This can be done, for example, by utilizing corona chargers 29*a*-29*c*, etc. controlled by electrometers 26*a*-26*f*, etc.

Carrier scavengers can be used downstream from the toning stations, and could be used after each toning station in FIG. 5 or for other configurations with individual toning stations. These scavengers are magnetic devices that remove magnetic particles from the substrate. The scavengers can also have a bias voltage for removing carrier particles from the substrate. The voltage can be DC, or DC with an AC component. Carrier particles can be supplied with the toner or paint particles to replace aged carrier in the system. If the developer level in the developer reservoir is high as determined by a level sensor, during a setup run when powder is not being applied to the substrate, the magnetic brush can be biased so that carrier is applied to the receiver and removed by a downstream scavenger. In this manner, excess carrier can be removed from the developer reservoir, or sump.

For some materials, the magnetic pole transitions produce noticeable banding on the coating. The banding probably consists of alternating heavy and light deposition. Using sensors, such as optical absorption sensors, densitometers, or cameras, it is possible to have a CPU alert an operator to the presence of banding. If the magnetic brush is driven by an independent drive motor, the process control algorithm can increase the rotational speed of the core, or of the shell and the core, to decrease banding.

For the configuration of FIG. 5, multiple toning stations can be used to produce a thick coating layer. If a first material is deposited in two or more layers by two or more magnetic brush applicators, banding can occur. To counteract this artifact, a phase relationship between the rotating cores can be maintained, so that, if magnetic pole transitions of upstream development stations, such as station 19*a*, produce banding in the image, the rotating core of downstream stations, such as station 19*b*, fill in the light bands in the image. The phase relationship may be maintained by gearing, with a differential for adjusting the phase of each roller relative to the other manually or automatically. It may also be maintained by individual electric motors for each magnetic core. Using sensors, such as optical density detectors or video cameras, a process control loop can be implemented to maintain a phase relationship between a first magnetic brush and a second magnetic brush so that a uniform coating free of banding is obtained.

Although the magnetic brush with a rotating core will typically be used with the shell rotating cocurrent with the receiver and the core rotating countercurrent to the direction of travel of the receiver, in certain situations it may be advantageous to utilize the shell rotating cocurrent with the receiver, countercurrent with the receiver, slowly moving in either direction or stationary, and either direction of core rotation.

For example, the configuration shown in FIG. 5 may be used to develop layers of different materials with:

Preferably for depositing a single layer, toning station 19*a* having a shell stationary or slowly rotating cocurrent with the receiver, a core moving countercurrent.

Toning station 19*a* used for depositing a first layer of a first material, and having a shell rotating countercurrent with the receiver, a core rotating cocurrent.

Toning station 19*b* used for depositing a second layer of a first material, and having a shell rotating cocurrent with the receiver and a core rotating countercurrent.

Toning station 19*b* used for depositing a second material, having a shell rotating cocurrent with the receiver, a core rotating cocurrent, and a spacing from the shell to the receiver such that the developer nap is not in contact with the receiver. DC and AC bias will be used on station 19*c* for projection coating. This reduces the amount of the first material that contaminates station 19*c*.

Control of the coating thickness can be performed by monitoring the thickness and adjusting the bias voltage for the magnetic brush. A negative voltage is required for depositing negatively-charged powder onto a grounded substrate. A positive voltage is required for positively-charged powder. Increasing the magnitude of the voltage increases the mass area density of powder deposited onto the substrate. The amount of material on the substrate can be measured using optical absorption or optical density, thickness measuring devices 44, or by other devices such as a densitometer known in the art. Measurement of developer current and the voltage of the coating can be used to calculate the thickness of the coating. The charge deposited on the substrate per unit area Q/A can be calculated from measurements of the electric current I to the developer station during deposition, the speed of the substrate s, and the width of the coating w, as $Q/A = I/(sw)$. The charge density per unit area Q/A equals the charge density per unit volume $\rho_Q$ times the coating thickness T, or $Q/A = \rho_Q T$. The voltage of the coating, as noted earlier and shown in FIG. 2*f*, is proportional to the thickness squared, and more exactly, $V \propto \rho_Q T^2/2$ for a coating on a conductive, grounded substrate. Consequently, the thickness of the coating $T \propto kV/(Q/A)$, with the proportionality constant k depending on the relative dielectric constant $\epsilon_P$ and packing density f of the powder material as deposited, so that $k \propto 1/(\epsilon_P f)$. As mentioned previously, the voltage V of the coating can be measured by electrostatic voltmeters or electrometers and the developer station current can be measured by a number of means, including: the voltage drop across a resistor; a current to voltage converter, such as an LED driving a photocell; magnetically or inductively, using a Hall effect sensor or other means; and indirectly, such as by counting the number of times the output capacitor of a switching power supply is recharged per second, or by other means known in the art. If there is an undercoat on the substrate of thickness $T_U$, and the substrate is grounded and conductive, measurements of the voltage of the coating as deposited will contain a term proportional to the undercoat thickness, and $V \propto k\rho_Q T^2/2 + k_U \rho_Q T_U$, where $k_U \propto 1/\epsilon_U$ and $\epsilon_U$ is the dielectric constant for the undercoat. Compensation for this term can be included in process control. Similarly, compensation can be made in process control for a voltage on the substrate before the powder coating is applied and for a nonconductive substrate on a grounded or biased support. Calibration of this method is required for different materials, as it depends on the dielectric constant of the coating and the packing of the powder particles in the coating. As mentioned previously, for a cured coating, reflective laser displacement devices, contact devices such as indicators, or other means known in the art can be used to measure thickness. Electrostatic methods can also be used. For a non-conductive or semiconductive coating that has no net electric charge transported at a known substrate speed, the surface of the coating can be charged at a known charge per unit area. The thickness of the coating can be determined from the resulting voltage measured at the surface, the charge per unit area, and the dielectric constant of the coating, with corrections for the substrate material, undercoat, or precoat, or for any voltage initially present. From the thickness determined by either of these thickness measurement techniques, or from other commonly used thickness measurement techniques, and from the density of the coating material, the mass area density of the coating can be calculated.

Figure 6:
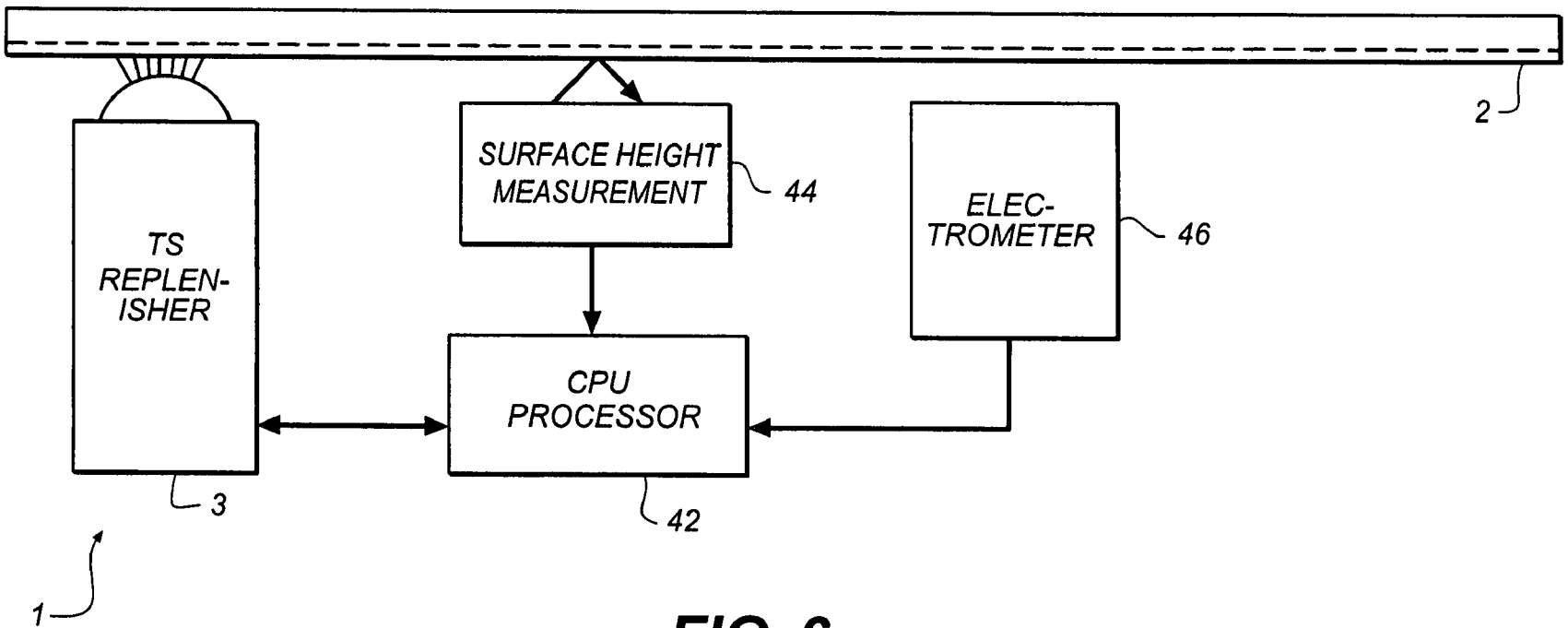
FIG. 6 is a schematic of a process control system for controlling the thickness of a powder coating.

All methods require adjustment for the presence of an undercoat, or for other factors, such as color of the substrate, for example, if densitometry is used. A process control loop for controlling the thickness of the deposition, in which the thickness is measured directly, is shown in FIG. 6. A laser triangulation device is used for thickness measurements, preferably a Keyence LK-031. (Manufactured by Keyence Corp. of America, 50 Tice Blvd., Woodcliff Lake, N.J. 07677) The analog voltage, proportional to distance from coating powder to sensor, is used as a control signal to set the shell potential in this closed loop system.

Fresh powder must be added to the developer reservoir to replace powder that has been deposited onto the substrate to form the powder coating. The concentration of powder in the developer reservoir can be controlled in several ways. A magnetic toner concentration monitor can be used to directly monitor the powder concentration as is known in the electrophotographic art. A signal from the monitor is used by a processor CPU 42 to control the replenisher and add fresh powder to the sump when the concentration falls below limits. Other methods of determining the average rate at which fresh powder should be added to the sump can be used.

Measurements of optical absorbance or density of the powder on the receiver can be used to calculate the amount of powder removed from the sump per unit time. An equivalent amount of powder can be added from the powder reservoir. This can be done in a continuous process or in a batch process. The amount of powder added from the toner reservoir can be determined by a level sensor that determines the amount of fresh powder in the powder reservoir 3 and feeds this information to CPU or processor 42. The powder concentration in the developer reservoir can also be determined indirectly by measuring the height of material in the reservoir. Fresh powder is added when this level decreases below limits.

The powder concentration in the developer reservoir 3 can also be determined indirectly by monitoring the surface voltage using an electrometer or voltmeter 46 for an electrostatic power coating. A schematic of a process control loop using this process for controlling the concentration of powder in the reservoir is shown in FIG. 6. Here the powder coating thickness is measured and the surface voltage of the coating is measured. After adjusting for the presence of undercoats, non-conductive or semiconductive substrates, and for preexisting voltages, the charge per mass, charge per unit volume, or charge per particle can be inferred from this measurement. Low powder concentration in the developer reservoir is associated with high powder charges. If the charge of the coated powder layer increases above limits, the rate at which fresh toner is added to the developer sump or reservoir is increased. As shown in FIG. 2*f*, for thin coatings, and particularly for coatings having area densities of 30 g/m$^2$ or less, the surface voltage is proportional to the square of the thickness of the coating and, from simple electrostatics, the surface voltage is also proportional to the charge per unit volume of the coating. The charge per unit volume of the coating is proportional to the average charge per particle and can be calculated from the average charge per particle, the particle size, and the packing fraction of the particles in the layer. The charge per unit mass of the particles is also proportional to the charge per unit volume of the coating by the density of the powder material. The processor in FIG. 6 may utilize a level shift and/or a gain shift for the thickness and voltage measurements before these measurements are used to determine if the voltage is large enough for a given coating thickness to increase the rate at which fresh toner is added to the developer sump. Other means for determining the amount of material per unit area of the coating can be used in place of thickness measurements, such as optical absorption or capacitance. For thin coatings, the voltage will be proportional to the square of the amount of material per unit area. For thicker coatings with the gray powder paint, as shown in FIG. 2*f*, electric breakdown occurs, limiting the maximum voltage for coatings greater than 30 microns for this material.

The foregoing description and the attached Appendices are provided for guidance only, and other features, embodiments, and implementations of the invention could be adopted within the scope thereof. For example, particular values of setpoints may be varied depending upon the geometry of particular embodiments/implementations constructed according to the invention or particular characteristics of the powder deposition stations in those embodiments/implementations. Therefore, it is intended that the invention encompass all such variations and modifications as fall within the scope of the appended claims and equivalents thereof.

A controller and supporting software are implemented to control the various functions described herein. Such implementation is well within ordinary skill in the relevant art. It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. The control implementation may be expressed in software, hardware, and/or firmware.

Figure 7:
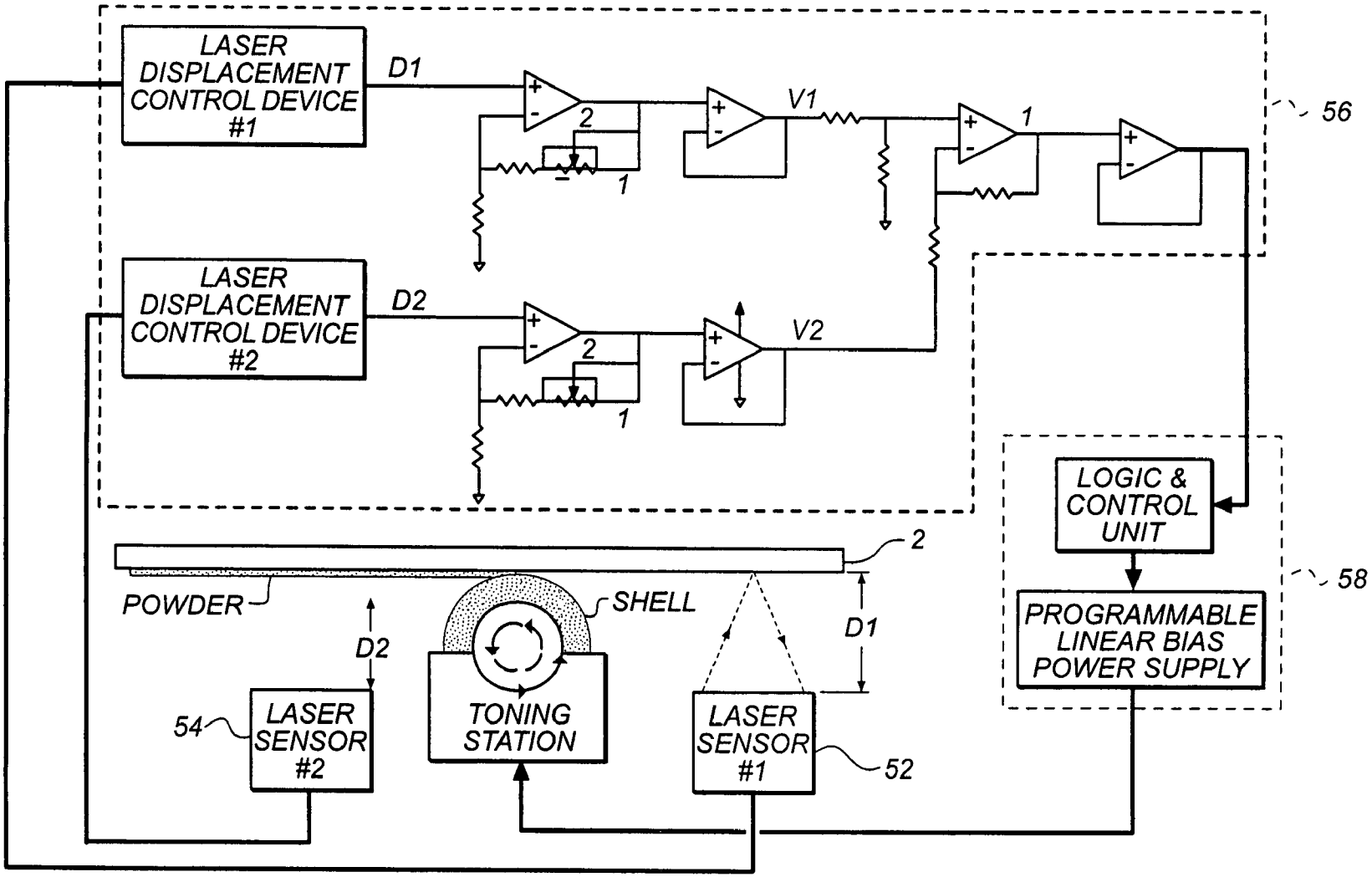
FIG. 7 is a schematic of a process control system for controlling the coating powder charge of a system.

Referring to FIG. 7, an exemplary control system 50 in accordance with the present invention includes a development station 1 for depositing marking material on a substrate 2. A laser sensor 52 measures a distance d1 to the surface of the unmarked substrate upstream from the development station 1. A laser sensor 54 measure the distance d2 to the surface of the marked substrate downstream of the development station 1. A calibration circuit 56 calibrates signals provided by sensors 52 and 54 and provides a difference signal representative of the thickness of the marking material deposited on the substrate 2 to logic and control unit (LCU) 58 or processor which controls the development station deposition.

In order to uniformly tone powder paints onto a substrate using an electrophotographic toning station, a means for sensing and controlling the target density and thickness of the material must be implemented. One desired system could include the technique of using a reflective laser displacement devices' analog output such as a Keyence LK-031. (Manufactured by Keyence Corp. of America, 50 Tice Blvd., Woodcliff Lake, N.J. 07677) The analog voltage, proportional to distance from powder paint to sensor, will be used as a control signal to set the shell potential in this closed loop system.

An in-line thickness feedback system provides stable control, reduces process variation and improves powder paint uniformity resulting in potential powder paint cost savings. In the preferred embodiment using two sensors, initial thickness set points made at the start of a coating process will be maintained by developing a control signal derived from the difference of the analog voltage of the displacement sensor that monitors the substrate minus the analog voltage of the displacement sensor that monitors the powder paint thickness. This signal provides the control processing unit (CPU) with real time powder paint thickness voltage. The CPU then sends an analog signal to a programmable high voltage power supply, which sets the toning shell potential to an optimized level. Once the coating has begun, an operator can steer the process to another level by monitoring the laser displacement displays and then making appropriate adjustments. If the laser displacement digital displays indicates a necessary change, an adjustment can be made to the shell voltage control signal, directly effecting the powder paint density to a new desired level. This technique also allows for rapid correction and control of coatings.

This invention can be used with one, two or more sensors located upstream, downstream or laterally adjacent. Multiple sensors can be used to measure the coating thickness uniformity. Cross-beam sensors could also be used. The sensors may also be other measurement devices, such as optical devices, electrometers, etc.

Referring to FIG. 8, development station 1 may be protected from protrusions 130 on the marking surface of substrate 2 by positioning a moveable shield 62 between the two prior to the protrusion reaching the development station 1. A support device 64 may be used to move the substrate away from the development station to clear the protrusion over the development station 1 and then position the substrate back to the proper development distance after the protrusion has passed the development station. As mentioned before, the backing bar would be moved away from the development station 1 to accommodate such movement of the substrate. A sensor 66 may be utilized to detect such protrusions.

Referring to FIG. 8, another example of the present invention comprises using a development station 1 to deposit marking material onto a photoconductor 72 in an electrophotographic process as described hereinbefore. The toner deposited on the photoconductor would be transferred to an intermediate transfer device and then deposited on the substrate 2. An inkjet system 76 may be used to deposit further materials onto the substrate to compliment or add to the image provided by the development station 1.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof. The claims should not be read as limited to the described order of elements unless stated to that effect. In addition, use of the term "means" in any claim is intended to invoke 35 U.S.C. §112, paragraph 6, and any claim without the word "means" is not so intended.

The invention claimed is:

1. An apparatus for applying powder coatings to a substrate comprising:

a reservoir of charged powder particles in the presence of hard carrier particles as a supply of powder coating material; and a magnetic brush having a rotatable shell coated with an insulative coating having more than a dielectric strength of 2100 vpm (volts per mil) surrounding a rotatable magnetic core, the a rotatable shell biased with a DC voltage greater then 1000 volts such that the maximum bias voltage for deposition is determined by the voltage drop across the insulative coating wherein that drop is a portion of a total drop from the shell to the receiver; and an electric field, having an AC and DC component, between the magnetic brush and a movable receiver for applying the powder coating material from the reservoir to the substrate.

2. An apparatus in accordance with claim 1, wherein the magnetic brush applies the powder coating by direct transfer wherein the surface speed of the shell is approximately 10% or less the speed of the substrate the powder paint is applied to.

3. An apparatus in accordance with claim 1, further comprising a intermediate transfer member comprising a non-conductive overcoat wherein the magnetic brush applies the powder coating by intermediate transfer from the reservoir to the intermediate transfer member and then on to the substrate.

4. An apparatus in accordance with claim 1, wherein the rotating magnetic field is provided by a rotating magnetic core wherein the rotating magnetic core rotates in one direction at about a first speed (RPM), and the shell rotates at about 10% of that first speed (RPM).

5. An apparatus in accordance with claim 1, wherein the powder coating material is comprised of one or more charge agents and at least one of the following: resin; binder; flow aids; surface treatments; pigment; leveling aids; cross-linkers; and catalysts wherein the charge agent(s) is combined to produce a recompounded powder paint at a temperature high enough to mix the charge agent while not changing the rheology of the powder paint including at least not substantially increasing viscosity.

6. An apparatus in accordance with claim 5, wherein the powder coating material is comprised of particles less than 50 micron volume mean diameter.

7. An apparatus in accordance with claim 5, wherein the powder coating material is prepared from an electrostatic spray powder paint at low temperature.

8. An apparatus in accordance with claim 1, wherein the magnetic brush has a magnetic brush nap height such that the rotatable shell and the movable receiver are spaced apart a distance that is greater then 30% of the magnetic brush nap height.

9. A powder coating apparatus comprising:

a reservoir of charged powder particles comprising filler in the presence of hard carrier particles;

a movable receiver for receiving charged powder particles from the reservoir of charged powder particles;

a rotatable shell comprising an insulative coating having more than a dielectric strength of 2100 vpm (volts per mil) and a rotatable magnetic core to feed the charged powder particles with carrier particles from the reservoir to a position proximate the movable receiver and to deposit at least a first and second layer of the charged powder particles on the receiver with a laminate in between to form a package;

an electric field, having an AC and DC component, between the rotatable shell and the movable receiver for applying the powder coating material from the reservoir to the substrate, the rotatable shell biased with a DC voltage greater then 1000 volts, the rotatable shell comprising a rotatable magnetic core, wherein the surface speed of the shell is approximately 10% or less the speed of the substrate the powder paint is applied to; and a heater to heat the package to yield a consolidated composite.

10. A powder coaling apparatus according to claim 9, wherein the receiver is an intermediate transfer drum, the apparatus further comprising a movable substrate, the intermediate transfer drum adapted to transfer particles to the movable substrate, the intermediate transfer drum further comprising a non-conductive overcoat.

11. A powder coaling apparatus according to claim 9, further comprising a plurality of deposition devices each having the rotatable magnetic core wherein the rotatable magnetic core rotates in one direction at about a speed (RPM), and the shell rotates at about 10% of that speed (RPM) and is positioned along the receiver, each of the plurality of deposition devices adapted to deposit powder particles onto the receiver.

12. A powder coating apparatus according to claim 11, further comprising a plurality of deposition devices positioned along opposite sides of the receiver, at least two of the plurality of deposition devices adapted to deposit powder particles onto the opposite sides of the receiver.

13. A powder coating apparatus according to claim 9, wherein the powder particles comprise a clear overcoat.

14. A powder coating apparatus according to claim 9, wherein the powder coating material is comprised of one or more charge agents and at least one of the following: resin; binder; flow aids; surface treatments; pigment; leveling aids; cross-linkers; and catalysts; wherein the charge agent(s) is combined to produce a recompounded powder paint at a temperature high enough to mix the charge agent while not changing the rheology of the powder paint including at least not substantially increasing viscosity.

15. A powder coating apparatus according to claim 14, wherein the powder coating material is comprised of particles less than 50 microns volume mean diameter.

16. A powder coating apparatus according to claim 14, wherein the powder coating material is prepared from an electrostatic spray powder paint at low temperature to incorporate addenda while not substantially increasing viscosity.

17. A powder coating apparatus according to claim 14, wherein the carrier is coated wit at least one of the following: resins; and polymeric materials.

18. An apparatus in accordance with claim 9, wherein the rotatable shell has a magnetic brush nap height such that the rotatable shell and the movable receiver are spaced apart a distance that is greater then 30% of the magnetic brush nap height.

* * * * *

UNITED STATES PATENT AND TRADEMARK OFFICE

CERTIFICATE OF CORRECTION

PATENT NO. : 7,481,884 B2
APPLICATION NO. : 11/075784
DATED : January 27, 2009
INVENTOR(S) : Eric C. Stelter et al.

It is certified that error appears in the above-identified patent and that said Letters Patent is hereby corrected as shown below:

Column 36, Line 10, delete “the a rotatable shell” and insert --the rotatable shell--

Column 37, Line 11, delete “coaling” insert --coating--

Column 37, Line 17, delete “coaling” and insert --coating--

Column 38, Line 20, delete “coated wit” and insert --coated with--

Signed and Sealed this

Fourteenth Day of July, 2009

John Doll

JOHN DOLL
*Acting Director of the United States Patent and Trademark Office*